US007921979B2

(12) United States Patent
Kreitz et al.

(10) Patent No.: US 7,921,979 B2
(45) **Date of Patent: *Apr. 12, 2011**

(54) BOTTLED WATER DISTRIBUTION METHOD AND BOTTLE RETURN APPARATUS

(75) Inventors: Michael Kreitz, Winston-Salem, NC (US); Christopher Holden, Winston-Salem, NC (US); Michael S. Gunter, Winston-Salem, NC (US); Brent C. Boydston, Winston-Salem, NC (US); Douglas A. Fullerton, Winston-Salem, NC (US); Billy D. Prim, Winston-Salem, NC (US); Robert C. Wiles, Winston-Salem, NC (US)

(73) Assignee: Primo Water Corporation, Winston-Salem, NC (US)

( * ) Notice: Subject to any disclaimer, the term of this patent is extended or adjusted under 35 U.S.C. 154(b) by 84 days.

This patent is subject to a terminal disclaimer.

(21) Appl. No.: 11/881,868

(22) Filed: Jul. 30, 2007 (Under 37 CFR 1.47)

(65) Prior Publication Data

US 2008/0121492 A1 May 29, 2008

Related U.S. Application Data

(63) Continuation-in-part of application No. 11/481,268, filed on Jul. 5, 2006.

(60) Provisional application No. 60/699,235, filed on Jul. 14, 2005.

(51) Int. Cl.
*G07F 7/02* (2006.01)
*G07F 7/10* (2006.01)

(52) U.S. Cl. ..... 194/211; 194/205

(58) Field of Classification Search ..... 194/205, 194/208–213; 209/539, 579, 635, 655, 698, 209/919, 924, 933, 522–533; 241/36, 81, 241/99, 100; 356/42, 72, 73

See application file for complete search history.

(56) References Cited

U.S. PATENT DOCUMENTS

| | | | | |
|---|---|---|---|---|
| 969,879 A | | 9/1910 | Karlson | |
| 1,995,779 A | | 3/1935 | Pencovic | |
| 2,931,535 A | * | 4/1960 | Lockwood | 206/507 |
| 2,954,111 A | | 9/1960 | Garrard | |
| 3,009,674 A | | 11/1961 | Ingvartsen | 248/120 |

(Continued)

FOREIGN PATENT DOCUMENTS

KR 615797 B1 8/2006

OTHER PUBLICATIONS

Post Office Box.

(Continued)

*Primary Examiner* — Jeffrey A Shapiro
(74) *Attorney, Agent, or Firm* — K&L Gates LLP

(57) ABSTRACT

Drinking water bottle return apparatus having a bin, a door or receiving tray movable between an open position and a closed position, a first sensor detecting when the door or receiving tray in the open position, a second sensor detecting a drinking water bottle entering the bin, and a receipt dispenser that dispenses a receipt in response to detection by the second sensor of a drinking water bottle entering the bin within a predetermined time period after detection by the first sensor of the door or receiving tray in the open position.

30 Claims, 19 Drawing Sheets

U.S. PATENT DOCUMENTS

| | | | | | |
|---|---|---|---|---|---|
| D223,956 | S | | 6/1972 | Kenerson | 49/35 |
| 3,973,237 | A | * | 8/1976 | Sawaguchi et al. | 235/379 |
| 4,090,633 | A | * | 5/1978 | Trubiano | 220/6 |
| 4,207,973 | A | | 6/1980 | Stampleman | 194/4 F |
| 4,245,731 | A | * | 1/1981 | Herbst et al. | 194/209 |
| 4,412,608 | A | * | 11/1983 | Kaspar et al. | 194/213 |
| 4,532,859 | A | | 8/1985 | Solørdal | 100/35 |
| 4,573,641 | A | | 3/1986 | DeWoolfson et al. | 241/36 |
| 4,579,216 | A | | 4/1986 | DeWoolfson et al. | |
| 4,653,627 | A | * | 3/1987 | Hampson et al. | 194/209 |
| 4,829,428 | A | | 5/1989 | Weitzman et al. | 364/401 |
| D307,343 | S | | 4/1990 | Lauraine, Jr. et al. | 34/1 |
| 4,947,988 | A | | 8/1990 | Schutz | 206/386 |
| 4,967,045 | A | | 10/1990 | Keefer | 200/296 |
| D314,655 | S | | 2/1991 | Hosmer | 34/40 |
| 5,028,099 | A | | 7/1991 | Bertucco | 312/250 |
| 5,042,634 | A | | 8/1991 | Gulmini | 194/209 |
| D324,593 | S | | 3/1992 | Kouwenhoven | 34/1 |
| 5,121,778 | A | | 6/1992 | Baker et al. | 141/319 |
| 5,161,661 | A | | 11/1992 | Hammond | 194/209 |
| 5,222,531 | A | | 6/1993 | Baker et al. | 141/18 |
| 5,289,855 | A | | 3/1994 | Baker et al. | 141/18 |
| 5,295,519 | A | | 3/1994 | Baker et al. | 141/18 |
| D349,997 | S | | 8/1994 | Ullmann | 34/1 |
| D351,697 | S | | 10/1994 | Blotnick | D34/1 |
| 5,361,913 | A | | 11/1994 | Melchionna | 209/583 |
| D355,289 | S | | 2/1995 | Schäfer | 34/1 |
| D361,039 | S | | 8/1995 | Rokus | D9/531 |
| 5,465,822 | A | | 11/1995 | DeWoolfson et al. | 194/209 |
| D377,553 | S | | 1/1997 | Cozart | 34/1 |
| 5,695,039 | A | * | 12/1997 | Driscoll et al. | 194/212 |
| D388,922 | S | | 1/1998 | Peters | 34/1 |
| 5,737,903 | A | | 4/1998 | Minutillo | 53/475 |
| D402,037 | S | | 12/1998 | Hofstad | 34/38 |
| D420,479 | S | | 2/2000 | Delmerico | 34/1 |
| 6,047,843 | A | | 4/2000 | Mecke | 220/23.88 |
| D428,229 | S | | 7/2000 | Olivetti | 34/1 |
| 6,223,927 | B1 | | 5/2001 | Rand | 220/495.06 |
| 6,299,061 | B1 | | 10/2001 | Henson | |
| 6,349,972 | B1 | | 2/2002 | Geiger et al. | |
| 6,547,055 | B2 | | 4/2003 | Coyne et al. | 194/207 |
| 6,575,290 | B2 | | 6/2003 | Löning et al. | 198/495 |
| 6,578,763 | B1 | | 6/2003 | Brown | 235/435 |
| 6,817,462 | B1 | | 11/2004 | Salda | 194/208 |
| 7,296,745 | B2 | | 11/2007 | Weisz et al. | 235/462.01 |
| 2003/0042110 | A1 | | 3/2003 | Wilfong | |
| 2003/0226884 | A1 | * | 12/2003 | Swider et al. | 232/26 |
| 2005/0073417 | A1 | | 4/2005 | Mathewson et al. | 340/572.1 |
| 2006/0065717 | A1 | | 3/2006 | Hurwitz et al. | 235/381 |
| 2006/0069642 | A1 | | 3/2006 | Doran et al. | 705/39 |
| 2006/0071063 | A1 | | 4/2006 | Duckett | |
| 2007/0090938 | A1 | | 4/2007 | Donaldson | 340/457 |
| 2007/0159308 | A1 | | 7/2007 | Johnston | 340/425.5 |
| 2008/0106089 | A1 | | 5/2008 | Geiger et al. | |

OTHER PUBLICATIONS

Night Deposit Box.

Excerpts from Registration Statement of Blue Rhino Corporation.

Underhill, Paco, "Why We Buy: The Science of Shopping", copyright 1999, Simon and Schuster, pp. 200-211.

First Translation of KR615797B1.

Second Translation of KR615797B1.

* cited by examiner

BOTTLED WATER DISTRIBUTION METHOD AND BOTTLE RETURN APPARATUS

CROSS-REFERENCE TO RELATED APPLICATIONS

This application is a continuation-in-part of co-pending U.S. patent application Ser. No. 11/481,268 filed on Jul. 5, 2006, which in turn is entitled to the benefit of, and claims priority to, provisional U.S. patent application Ser. No. 60/699,235 filed on Jul. 14, 2005, the entirety of each of which is incorporated herein by reference.

FIELD

1. Technical Field

The present invention relates to the field of beverage distribution and particularly to a new method and apparatus used in the distribution of bottled beverages such as bottled drinking water.

2. Background Information

Many residential and commercial water cooler devices use bottles of drinking water that contain at least one gallon—and often several gallons—of drinking water. Unless otherwise explicitly indicated, the terms "bottles," "bottled drinking water" and the like are used herein to refer to drinking water bottles intended for use with water cooler devices. Two such drinking water bottles are the three gallon and five-gallon sizes of t bottle disclosed in U.S. Design Pat. No. 361,039.

As those of skill in the art will appreciate, "water coolers" is a general term used to describe devices from which bottled drinking water is dispensed. Often, a drinking water bottle is disposed inverted on a water cooler device when in operation. Many water coolers are capable of not only cooling bottled drinking water, but also heating it as well. Thus, as used herein, the terms "water cooler," "water cooler device" and the like refer to any device from which bottled drinking water is dispensed, and not to any specific device or only to devices which in fact cool drinking water.

Typically, water bottles used with such cooler devices are not disposable and are intended for reuse. Because of this, such drinking water bottles are more sturdily constructed, and thus more expensive, than beverage bottles such as plastic soft drink bottles that are intended to be thrown away after a single use. Thus, even when empty drinking water bottles have value to a water distributor. Not only do such bottles represent a capital investment on the part of the distributor, but such bottles also represent potential sales because they can be cleaned, refilled and used multiple times.

Historically, water cooler devices were primarily used in businesses. Bottled water distributors entered into arrangements with businesses having water cooler devices. In such arrangements, a distributor would periodically deliver full bottles of drinking water to a business and retrieve empty drinking water bottles from the business. The distributor would then clean, sanitize, refill and reuse the empty bottles.

In recent years, however, the use of water cooler devices in residential settings has significantly increased. It is suspected that this increase is due, at least in part, to an increase in consumer demand for pure drinking water and to a decline in prices of water cooler devices. This increased residential demand for bottled drinking water has created a challenge for the historical bottled water distribution system. While there are now more bottled water customers, many of these customers are residential customers that do not have as high of a recurring demand for bottled water as the traditional business customers. It is thus often less economically efficient for a bottled water distributor to make home deliveries as it is for the distributor to make business deliveries.

In an attempt to address this challenge, bottled water distributors have begun entering into arrangements with retailers. In such arrangements, the bottled water distributor periodically delivers full drinking water bottles to retailers and the retailers sell full water bottles to their customers.

It should be understood that the terms "retailer" and "seller" as used herein refer to an individual, group of individuals, company or other entity that sell goods or services, regardless of whether such sales are "at retail." Similarly, the term "store" as used herein refers to any location at which sales are made, regardless of whether such location be an actual store that is open to the public.

While these retail arrangements are advantageous in that they serve the needs of residential bottled water customers in a more economically efficient manner than home deliveries, the fact that the drinking water bottles are reusable creates at least two significant problems for retailers. The first problem is that retail personnel must be used to receive and verify customer returns of empty bottles. Because customers are usually charged less for a full bottle of drinking water when they return an empty bottle, each store selling bottled water must have a way of verifying whether or not a customer buying a full bottle of drinking water has returned an empty bottle. In known distribution methods, one of the retailer's employees is used to manually receive each empty drinking water bottle returned by a customer. This means that such employee must temporarily stop what he or she is doing when a customer returns an empty drinking water bottle.

A second significant problem created for retailers in known methods of distributing bottled drinking water is that the retailer must financially manage deposit amounts. Because empty drinking water bottles have value to distributors, bottled water distributors often charge retailers a deposit for each bottle of drinking water delivered to the retailer to ensure that the distributor gets empty bottles back from the retailer or is made whole for the loss of bottles that are not returned. Retailers typically pass the deposit amounts on to their customers. The result of the deposit system is that retailers are forced to carry the deposit amounts on their financial books, give refunds to customers when empty bottles are returned but full bottles are not purchased, and reconcile deposit amounts with bottled water distributors.

The necessity of using store personnel to verify and receive empty bottles returned from customers and the burden of managing deposit amounts create significant deterrents to wide-spread adoption of retail bottled water distribution arrangements.

What is needed in the art is a new way of distributing bottled drinking water using retailers that will not burden retail personnel with additional obligations such as receiving empty bottles returned by customers and managing deposit amounts.

SUMMARY

The present invention overcomes the disadvantage of having to use store personnel to verify and receive empty bottles returned from customers by providing a new bottle return apparatus.

A drinking water bottle return apparatus includes a bin capable of holding empty bottles, a door allowing for removal of empty bottles, means for receiving bottles into the bin, a bottle sensor to detect bottles received into the bin and a receipt dispenser that dispenses a receipt in response to detection by the bottle sensor of a bottle received into the bin. A bottle deposited into the empty bin falls by gravity until stopped by the bottom of the bin and is detected by the bottle sensor, which causes the receipt dispenser to dispense a receipt for the bottle. One or more circulation openings may be provided to allow air outside of the bin to circulate among bottles in the bin. Means for receiving bottles into the bin may include a receiving chute or a rotatably mounted receiving tray. The means for receiving bottles into the bin may have a size and shape such that only one bottle at a time can be received into the bin. The bottle sensor may detect a bottle as it passes through the means for receiving bottles into the bin. The bottle sensor may detect a bottle as it falls by gravity in the interior of the bin. The bottle sensor may be a mechanical, electro optical, RFID or other device. Receipts dispensed by the apparatus may include a universal product code, stock keeping unit or other product identifying information. Receipts dispensed by the apparatus may include an RFID tag. The door, receipt dispenser and receiving means may be accessible from the same side of the bin, as may be a circulation opening.

Another preferred embodiment of a drinking water bottle return apparatus includes a bin, a door or receiving tray, first and second sensors and a receipt dispenser. The bin has an interior space capable of holding a plurality of drinking water bottles of predetermined size. The receiving tray or door is movable between an open position and a closed position. The receiving tray or door is adapted and positioned such that when in the open position a drinking water bottle of predetermined size can be placed in the receiving tray or through the door from outside of the apparatus. When the receiving tray is moved from the open position to the closed position a drinking water bottle previously placed in the receiving tray while in the open position enters into the bin. A first sensor detects the door or receiving tray in the open position and a second sensor detects a drinking water bottle of predetermined size entering the bin. Operatively connected to the first and second sensors is a receipt dispenser configured to dispense a receipt in response to detection by the second sensor of a drinking water bottle entering the bin within a predetermined time period after the first sensor detects the door or receiving tray in the open position.

The receiving tray may be such that a drinking water bottle cannot pass therethrough when in the open position. The receiving tray or door may be oriented such that it rotates at least partially about a generally horizontal axis as it moves between the closed position and the open position, or the receiving tray or door may be oriented such that it rotates at least partially about a generally vertical axis as it moves between the closed position and the open position. The receiving tray or door may be biased in the closed position by a suitable mechanism, such as a spring connecting the receiving tray or door and the bin. A weight may be affixed to the receiving tray to further bias the receiving tray in the closed position.

The predetermined period of time may be made to commence when the first sensor initially detects the receiving tray or door as it moves from the closed position toward the open position. The predetermined period of time may be made to commence when the first sensor no longer detects the receiving tray or door as it moves from the open position toward the closed position. The predetermined period of time may advantageously be less than ten seconds, and may be between two and six seconds.

An activation tab may be affixed to the receiving tray such that the activation tab is spaced a predetermined distance from the first sensor when the receiving tray is in the open position and such predetermined distance is within the detection range of the first sensor. A predetermined distance within the range of about four millimeters and about one hundred millimeters be advantageously be used in association with a first sensor having a detection range of between approximately 1 mm and 100 mm.

The first and second sensors may be of any suitable type of sensor, including an inductive proximity sensor, magnetic sensor, mechanical sensor, electro-optical sensor or the like. The sensors may be RFID readers if the apparatus is intended for use with bottles having RFID tags. The first sensor may be adapted and positioned such that it does not detect the receiving tray or door in the closed position.

BRIEF DESCRIPTION OF THE DRAWINGS

For a more complete understanding of this invention reference should now be had to the preferred embodiments illustrated in greater detail in the accompanying drawings and described below. In the drawings, which are not necessarily to scale.

DESCRIPTION

The present invention will now be described fully hereinafter with reference to the accompanying drawings, in which preferred embodiments of the invention are shown. This invention may, however, be embodied in many different forms and should not be construed as limited to the preferred embodiments set forth herein. Rather, these preferred embodiments are provided so that this disclosure will be thorough and complete, and will fully convey the scope of the invention to those skilled in the art. It will be understood that all alternatives, modifications, and equivalents are intended to be included within the spirit and scope of the invention as defined by the appended claims.

The present invention solves problems created for retailers by previous bottled water distribution systems by providing a new empty bottle return apparatus, a new bottled water distribution method and a new method of selling bottled water products. The apparatus of the present invention receives empty bottles being returned, issues a receipt therefore and stores a plurality of empty bottles until they are retrieved by a bottled water distributor. Thus, the present invention allows a retailer to sell bottled water without the need to use store personnel for receiving and storing empty bottles returned to the store by its customers.

Figure 1:
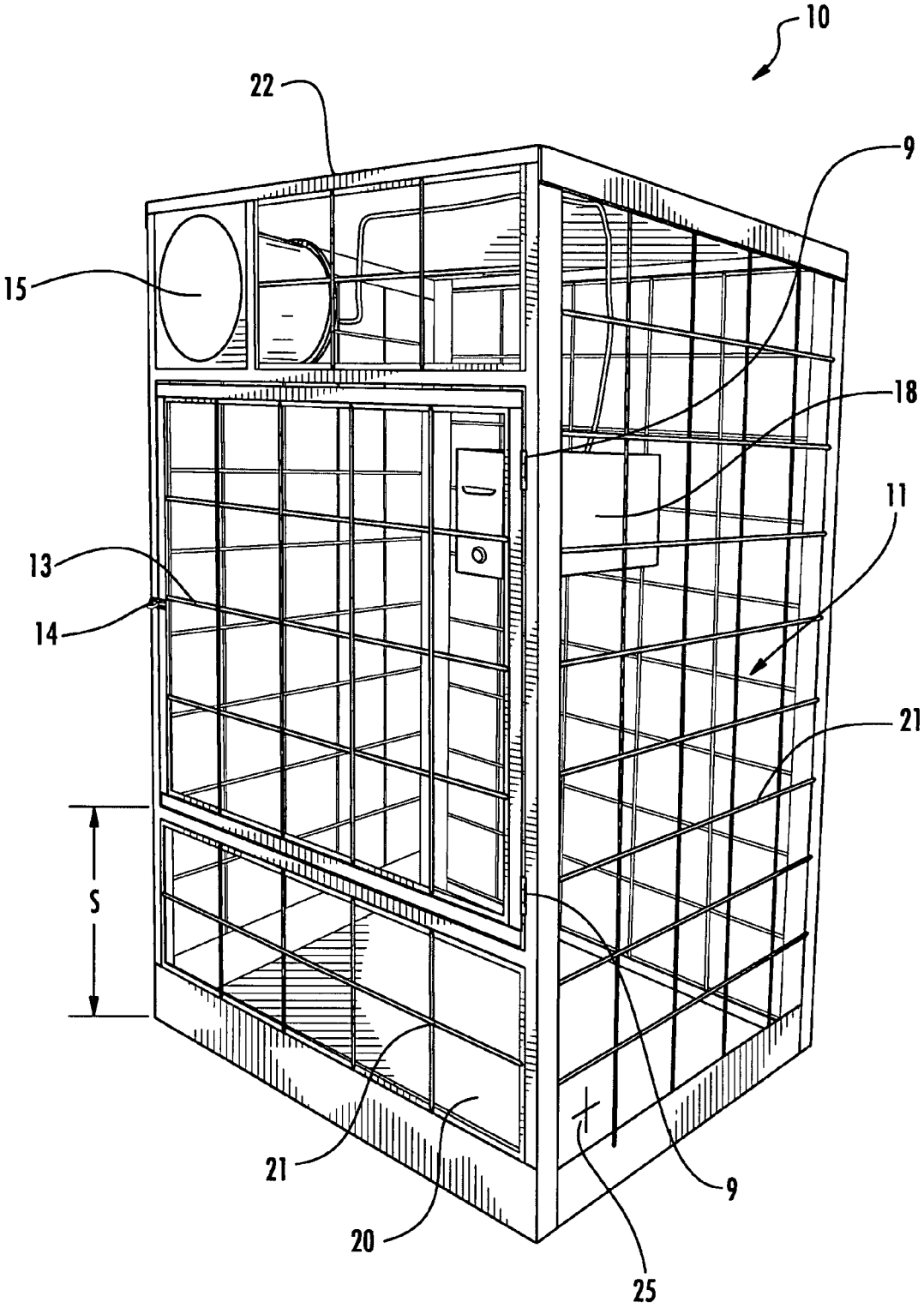
FIG. 1 is a perspective view of a bottle return apparatus in accordance with a preferred embodiment of the present invention.
Figure 2:
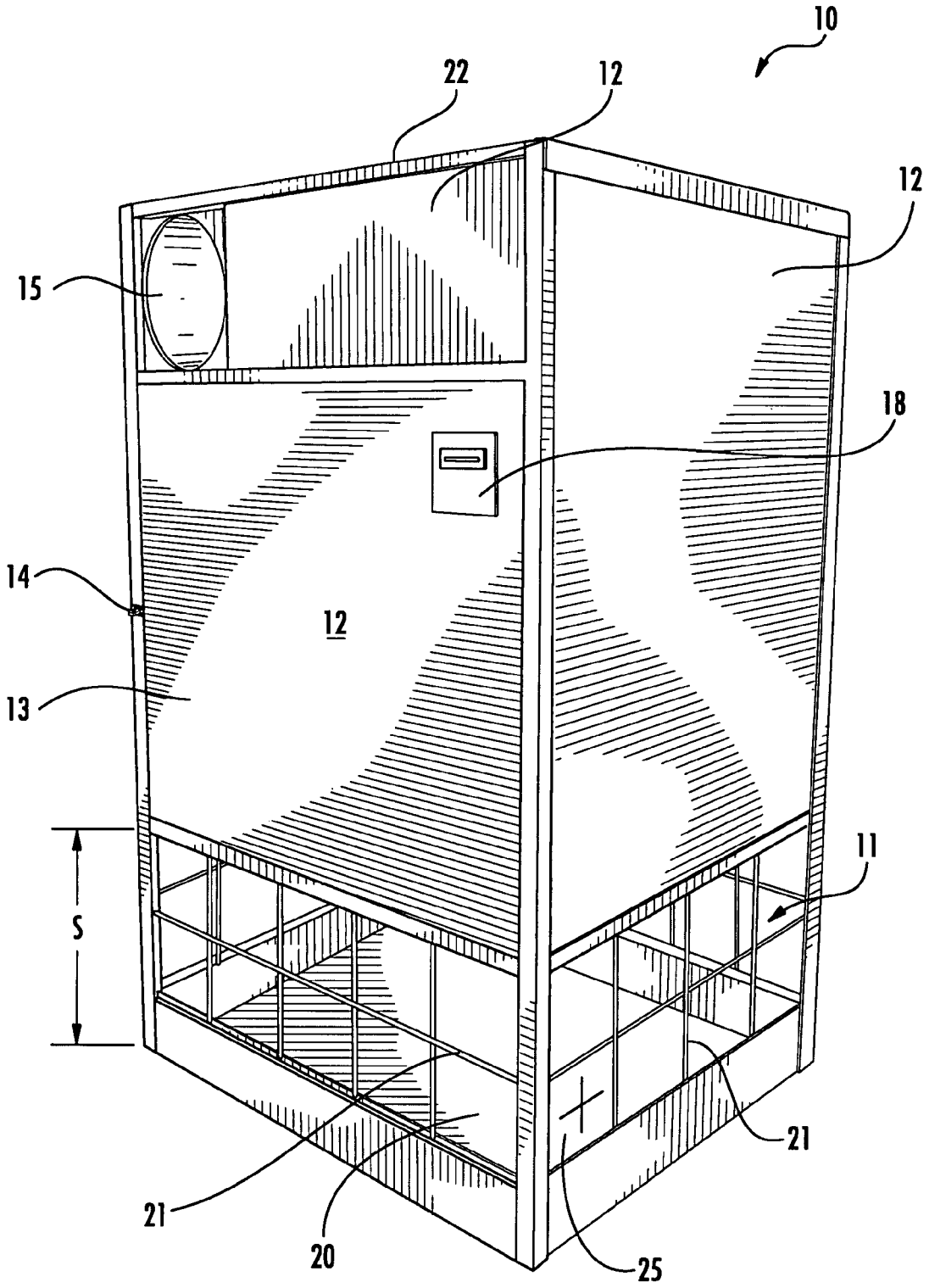
FIG. 2 is a perspective view of a preferred embodiment of the bottle return apparatus of FIG. 1 in which panels are affixed to the bottle return apparatus.
Figure 3:
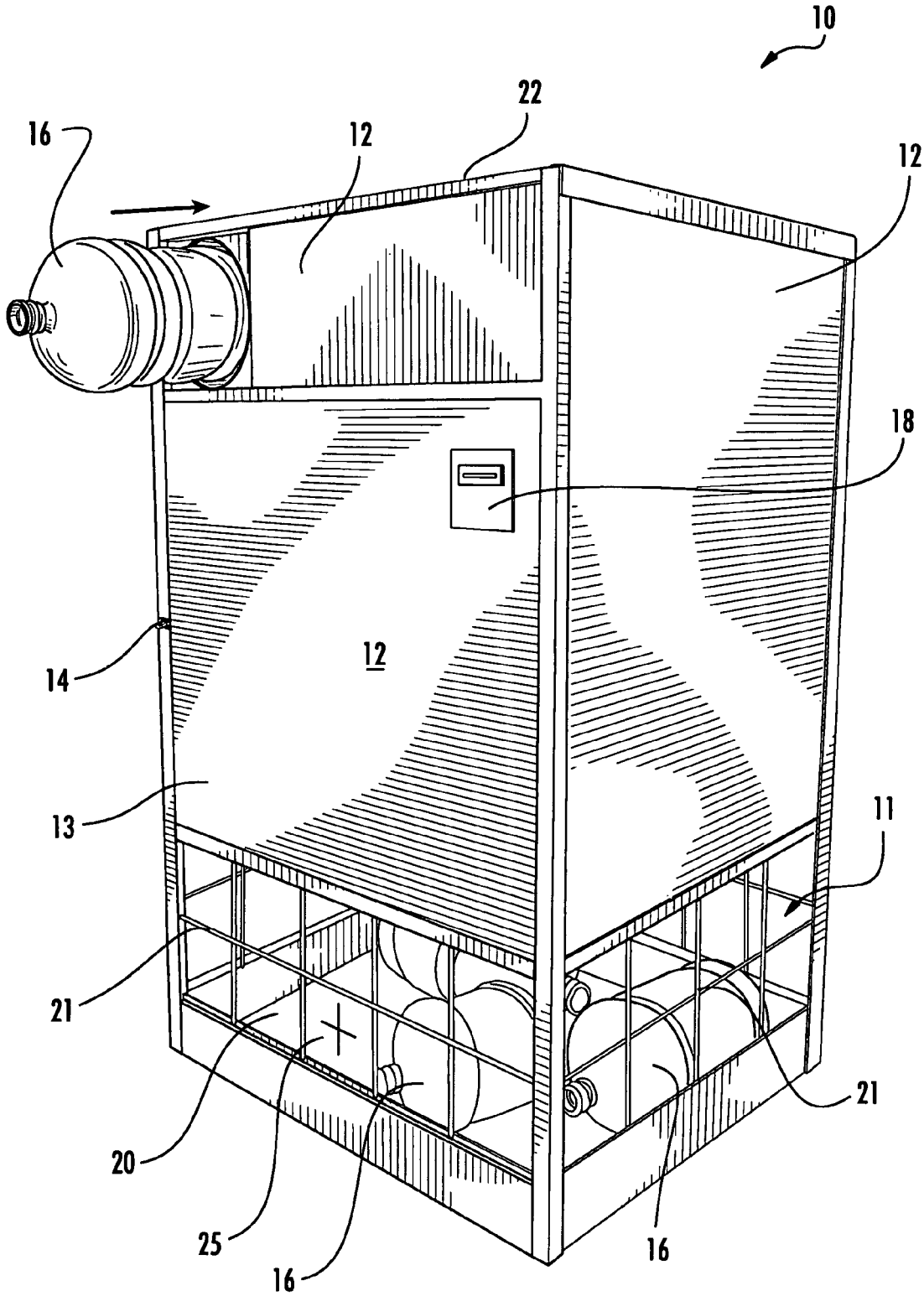
FIG. 3 is a perspective view of the bottle return apparatus of FIG. 2 illustrating the receipt of an empty bottle into the apparatus.
Figure 4:
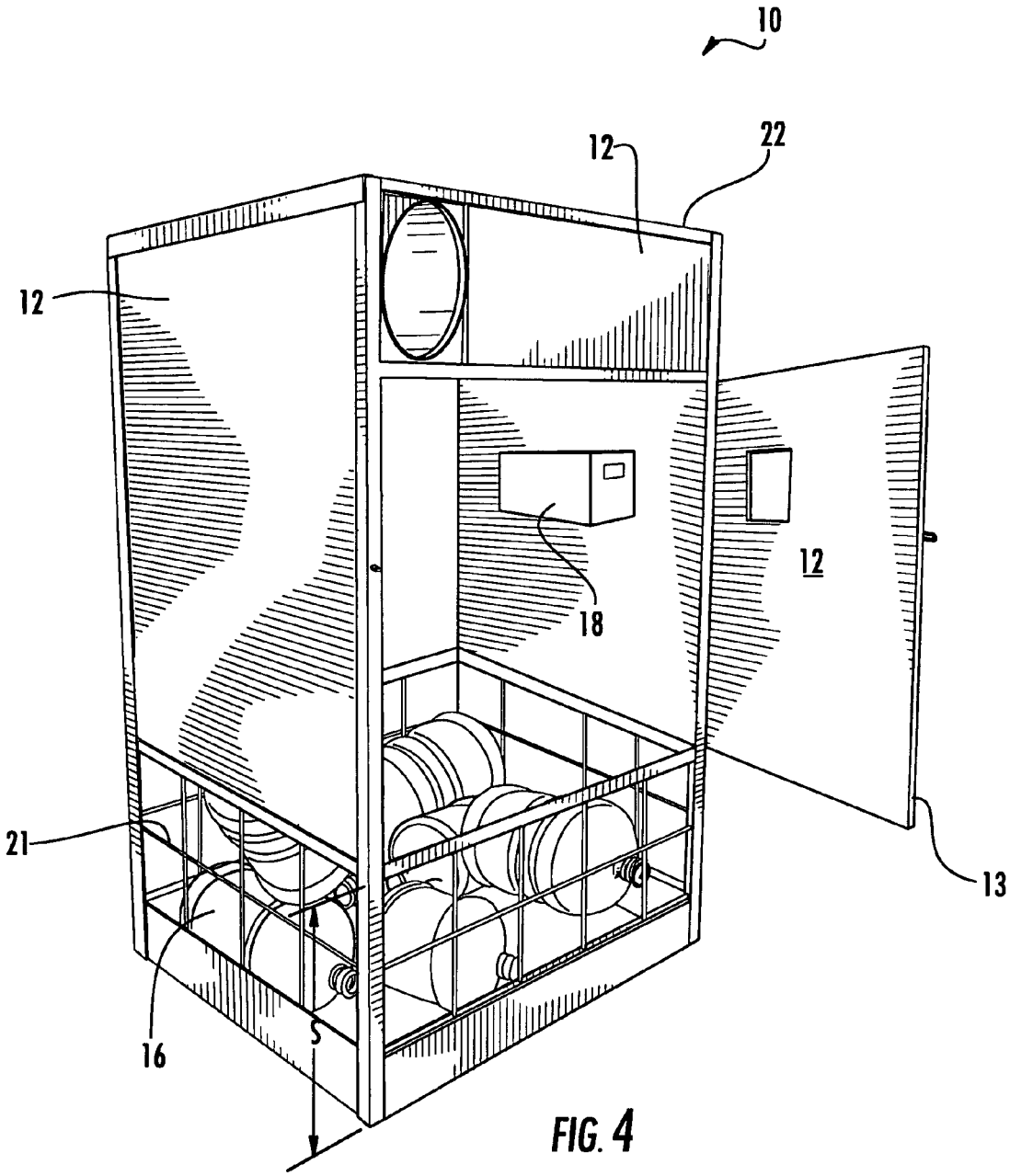
FIG. 4 is a perspective view of the bottle return apparatus of FIG. 2 with the door open (and with wires connecting the sensor(s) and the receipt dispenser not shown)

A preferred embodiment of a return apparatus according to the present invention is depicted in FIGS. 1-10. Turning now to FIGS. 1-3, a bottle return apparatus 10 has a bin 11 that is capable of holding a plurality of empty drinking water bottles. As those in the art will appreciate, the size of the bin 11 may be selected based upon considerations such as space limitations in the desired bin location, the size of empty bottles desired to be deposited in the bin, the anticipated or actual rate of bottle return in the location of the bin, the anticipated or actual time between pick-ups of empty water bottles from the bin 11, the desired number of empty water bottles that will be stored in the bin 11 and the desired method of transporting the apparatus. Advantageously, the shape or "footprint" of the apparatus 10 may be designed such that it is suitable for movement on a standard pallet.

The bin 11 has a plurality of walls 21 and a top 22. The bin 11, walls 21 and top 22 may be composed of any suitable materials. If the apparatus is intended to be placed outdoors, then the materials used to construct the bin 11, and particularly the walls 21 and top 22, should be suitable weather-resistant materials. For example, the walls 21 and top 22 may be composed of wire or steel mesh material. In addition, the walls 21 and top 22 may be composed of a solid material. In a preferred embodiment, illustrated in FIGS. 1-3, the bin 11 has four walls 21. A suitable bin 11 in accordance a preferred embodiment of the present invention may be constructed using a top 22 fabricated from 22 gauge steel and walls 21 fabricated from 16 gauge steel and 0.207 inch diameter steel rods.

The bin 11 has at least one door 13 that is movable between a closed position (illustrated in FIGS. 1-3) that retains empty water bottles 16 in the interior of the bin 11, and an open position (illustrated in FIG. 4) that allows access to the interior of the bin 11 for removal of empty water bottles 16 inside the bin 11. The door 13 may be affixed to the bin 11 by any suitable means. In a preferred embodiment, depicted in FIG. 1, the door is connected to the bin 11 by hinges 9 so that the door 13 swings outward and away from the bin 11 to permit access to the contents of the bin 11.

The door 13 may be any desired shape and size, provided that the shape and size of the door permit removal of empty bottles 16 within the bin 11 through the door 13 when the door is open. A latch 14 may be used to hold the door 13 in the closed position. The latch 14 may also be used in conjunction with a padlock or other locking mechanism (not illustrated) for securing the door 13 in the closed position. A spring mechanism, or other known devices, may be used to keep the door biased in the closed position.

While only a single door has been illustrated in the present application, those in the art will appreciate that more than one door may be used, including the use of so-called "French doors." Moreover, while a generally square door has been illustrated, those in the art will appreciate that the door may be any suitable shape.

Advantageously, the door 13 may be spaced from the bottom of the bin 11 by a suitable distance S (see FIGS. 1, 2 and 4) to retain at least a portion of the empty bottles 16 within the bin 11 when the door 13 is in the open position.

The bottom 20 of the apparatus 10 may be constructed of any suitable material. Preferably, the bottom 20 should be a material that will not cause bottle breakage or damage when a bottle 16 impacts the bottom 20 upon being deposited in the bin 11. It should be noted that as used herein, "bottom" means the surface upon the first empty bottle 16 deposited in the bin 11 comes to rest. The bottom 20 may be a structural member that is connected to one or more of the walls 21. Alternatively, the bottom 20 need not be connected to the bin 11. For example, the bottom 20 may be the ground, pallet or other surface upon which the apparatus 10 is positioned. Alternatively, the bottom 20 may be a cushioning or protective material (such as foam or rubber padding) that is positioned inside the apparatus. The bottom 20 may be a water-absorbent material, which may be advantageously used if the apparatus is located indoors. The bottom 20 may be a non water-absorbent material, which may be advantageously used if the apparatus is located outdoors where water absorption by the bottom would facilitate mold formation or other undesirable conditions. The bottom 20 may be a so-called "closed cell" material.

As depicted in FIGS. 2, 3, 4, 9 and 16, panels 12 may be affixed to the walls 21 and door 13 of the bin 11. Advertisements, instructions, decorative graphics text or the like may adorn the outside of the panels 12 or walls 21. If panels 12 are affixed to the walls 21, or if solid materials are used for the walls 21 and the top 22, consideration should be given to selecting materials that can satisfactorily withstand the anticipated weather conditions if the bin 11 is to be located outdoors. It may also be advantageous to select a material capable of shielding empty bottles contained within the bin 11 from exposure to excess sunlight if the bottles are made from a material (such as some forms of polycarbonate) that suffers degradation or discoloration from prolonged exposure to sunlight.

Various means may be used for receiving empty bottles 16 into the bin 11. One such means that may be advantageously used, which is illustrated in FIGS. 1-9, is a receiving chute. A receiving chute 15 provides an opening from the exterior of the bin 11 into the interior of the bin 11 so as to permit a empty bottle 16 traveling through the receiving chute 15 to enter the bin 11. The receiving chute 15 may be spaced higher in the vertical direction than the bottom 20 so as to allow empty bottles 16 traveling there through to drop by gravity to the bottom 20. All or a portion of the receiving chute 15 may, but need not necessarily, extend outwardly (i.e., in a direction away from the interior of the bin 11) from a wall 21 of the apparatus 10. All or a portion of the receiving chute 15 may, but need not necessarily, extend inwardly (i.e., in a direction toward the interior of the bin 11) from a wall 21 of the apparatus 10. Extending at least a portion of the receiving chute 15 for a predetermined distance into the interior space of the bin 11 may be used to ensure accurate positioning of empty bottles inserted into the bin 11 relative to the bottle sensor (discussed below).

In determining the size and shape of the receiving chute 15, it is useful to consider the size, shape and dimensions of bottles intended to be deposited in the apparatus. As used herein, the term "bottle of predetermined size" means a bottle of the type, and having the shape, size and dimensions, that is intended to be deposited in the apparatus. The receiving chute 15 may, but need not necessarily, be designed to ensure that empty bottles of predetermined size can only be inserted into the apparatus 10 in one orientation. The shape and length of the receiving chute 15 may, but need not necessarily, be designed to ensure that only one bottle of predetermined size at a time can be inserted into the apparatus. The receiving chute 15 may be positioned high enough in the vertical direction so as to allow a desired number of empty bottles 16 to be received and stored in the bin 11.

Figure 7:
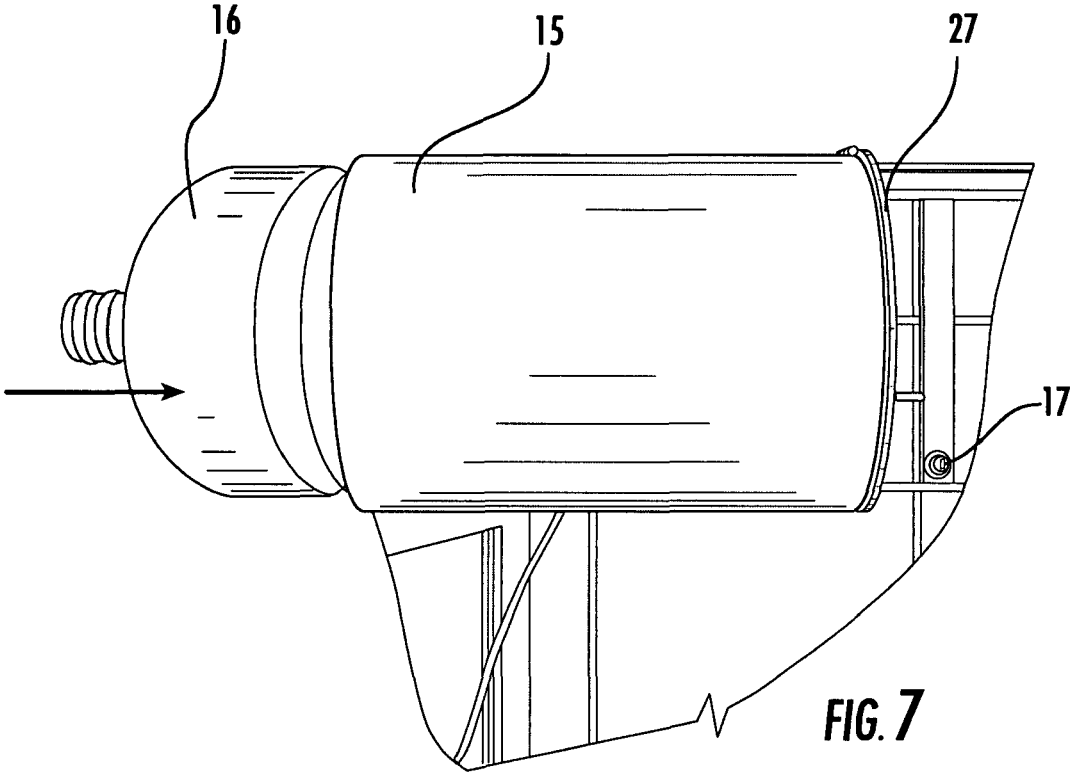
FIGS. 7 and 8 are cutaway elevation views illustrating the receipt of an empty bottle into the apparatus of FIG. 1 and the detection of the empty bottle by the bottle sensor.
Figure 8:
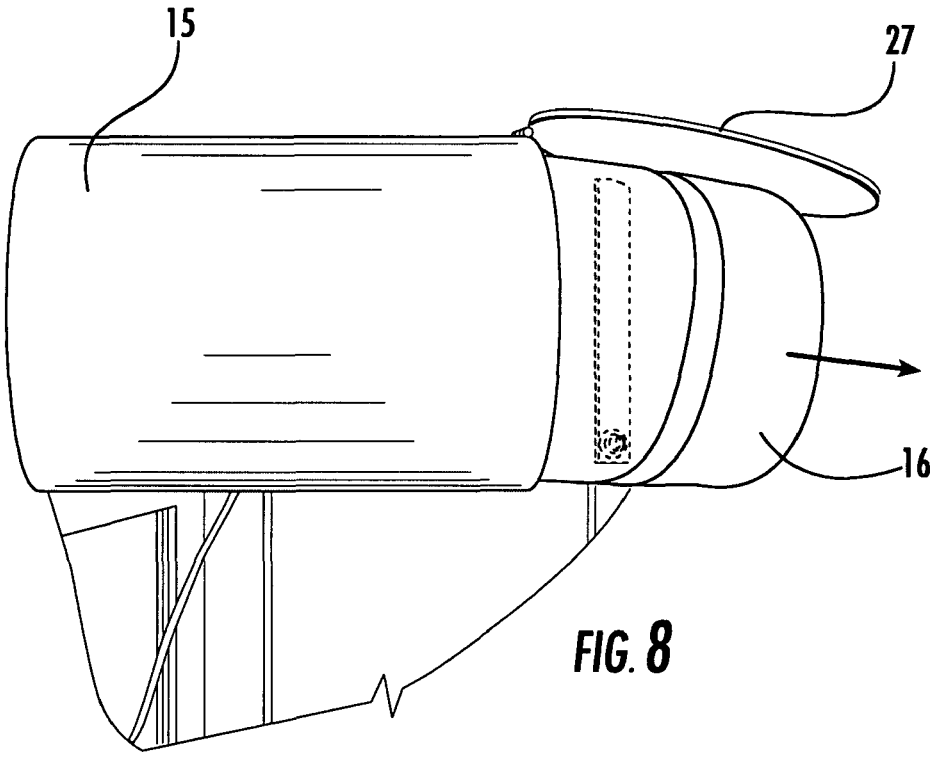

FIGS. 3, 7 and 8 illustrate the insertion of a bottle 16 into the apparatus through a generally cylindrical receiving chute 15. In these illustrations, the receiving chute 15 is sized and configured such that empty bottles 16 are permitted to pass through the receiving chute 15 only in the bottle's longitudinal direction. If it is desired that the apparatus 10 be used to collect and store generally cylindrical bottles and that such bottles be received into the apparatus only in the longitudinal direction, then the diameter of the receiving chute should be selected such that it is greater than the diameter of the bottles of predetermined size but less than the length of such bottles.

It has been found that three gallon and five gallon sized bottles of the type disclosed in U.S. Design Pat. No. 361,039 and manufactured by Reid Plastics, Inc. may be advantageously used with the present invention. When such bottles are used, a receiving chute 15 having a diameter of between ten inches and eleven inches and a length of between twelve inches and twenty-six inches may be advantageously used. Suitable three gallon and five gallon sized bottles may also be obtained from a variety of other manufacturers, including Grief, Inc. and Consolidated Container Corporation.

As illustrated in FIGS. 7 and 8, a moveable flap 27 may be used to cover an opening of the receiving chute 15. FIGS. 7 and 8 depict a movable flap 27 covering the opening of the receiving chute 15 in the interior of the bin 11. A movable flap 27 may also be used to cover the other opening of the receiving chute 15 (i.e., the first opening of the receiving chute 15 that a bottle 16 encounters when being inserted into the bin 11). A movable flap 27 may also be used to cover both openings of the receiving chute 15. Positioning a movable flap 27 over the exterior opening of the receiving chute 15 may require that person depositing a bottle into the apparatus manually open such flap 27 in order to access the opening of the receiving chute 15.

The movable flap 27 may be made from any suitable material and may be made from the same material as the receiving chute 15. As those skilled in the art will appreciate, there are many ways to attach a flap 27 to a receiving chute 15 in a way that will permit the flap 27 to move and allow a bottle 16 to travel completely through the receiving chute 15. Such mechanisms include, but are not limited to, hinge mechanisms, spring mechanisms, rotating mechanisms, and the like. For example, the flap 27 may be attached by a hinge as illustrated in FIG. 8. The flap 27 is thus permitted to swing between a closed position (illustrated in FIG. 7) wherein the flap 27 rests against the receiving chute 15 and an open position (illustrated in FIG. 8) permitting empty bottles 16 to travel completely through the receiving chute 15 and into the bin 11. The movable flap 27 may be configured to move from the closed position to the open position by the force of a bottle 16 being inserted through the receiving chute 15 (illustrated in FIG. 8).

Presuming that the receiving chute 15 is spaced in the vertical direction from the bottom 20, an empty bottle 16 passing completely through the receiving chute 15 falls to the bottom 20 by gravity. Thereafter, the movable flap 27 returns to the closed position.

As illustrated in FIGS. 5-8, a bottle sensor 17 detects bottles 16 entering the bin 11. The bottle sensor 17 may be any sensor capable of detecting the presence of an object such as a bottle and may, for example, be a mechanical, electrical, magnetic or optical sensor, all of which are known to those in the art. The bottle sensor 17 may also be a Radio Frequency Identification ("RFID") reader or other device capable of detecting the presence of RFID tags or so-called "smart labels" on water bottles entering the apparatus.

One manual sensor suitable for use in the present invention is a general purpose limit switch, such as the limit switch manufactured by Honeywell International, Inc. and designated as manufacturer part number SZL-VL-F. One optical sensor suitable for use in the present invention is a photoelectric proximity detector, such as the photoelectric proximity detector manufactured by SICK, Inc. and designated model number ET1-N222 and part number 7027227, which has a nominal sensing range of between 1 mm and 100 mm.

The bottle sensor 17 is located such that an empty bottle 16 entering the bin 11 is detected. The bottle sensor 17 may, for example, be located inside the receiving chute 15. Alternatively, the bottle sensor 17 may be positioned in the bin 11 at such a location that a bottle 16 contacts a mechanical bottle sensor or passes through the field of view of an optical bottle sensor upon entering the bin 11. The bottle sensor 17 may also be positioned such that an empty bottle 16 having passed through the receiving chute 15 is detected by the bottle sensor 17 as the bottle 16 falls by gravity into the interior of the bin 11.

If the bottle sensor 17 used is a device capable of detecting an RFID tag on a bottle being deposited in the bin 11, consideration should be given to ensuring that the presence of one or more RFID tags on bottles already contained within the bin does not interfere with the detection of an RFID tag on a bottle that is being deposited into the bin. For example, such a bottle sensor could be positioned such that RFID tags on empty bottles being deposited into the bin 11 are within the field of view of the bottle sensor 17 but RFID tags on empty bottles having been previously deposited into the bin 11 are not within the field of view of the bottle sensor 17.

FIGS. 5-8 illustrate an advantageous placement of an optical bottle sensor. The bottle sensor 17 is positioned in the bin 11 on the interior side of a wall 21 near the interior opening of the receiving chute 15 such that a bottle 16 exiting the receiving chute 15 is detected by the bottle sensor 17.

Figure 5:
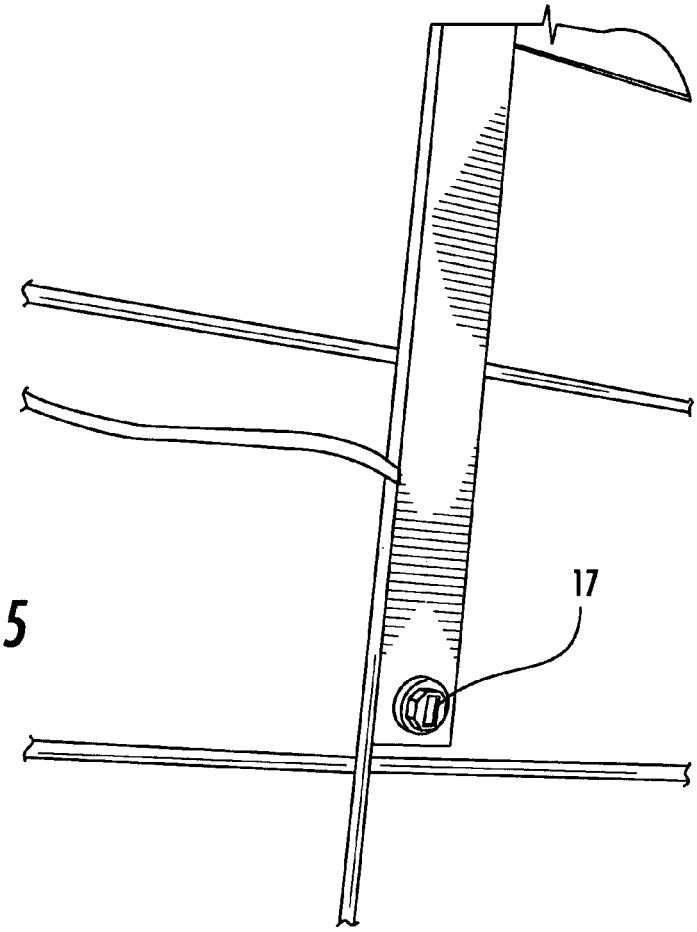
FIG. 5 is a cutaway elevation view of a bottle sensor of the bottle return apparatus of FIG. 1.
Figure 6:
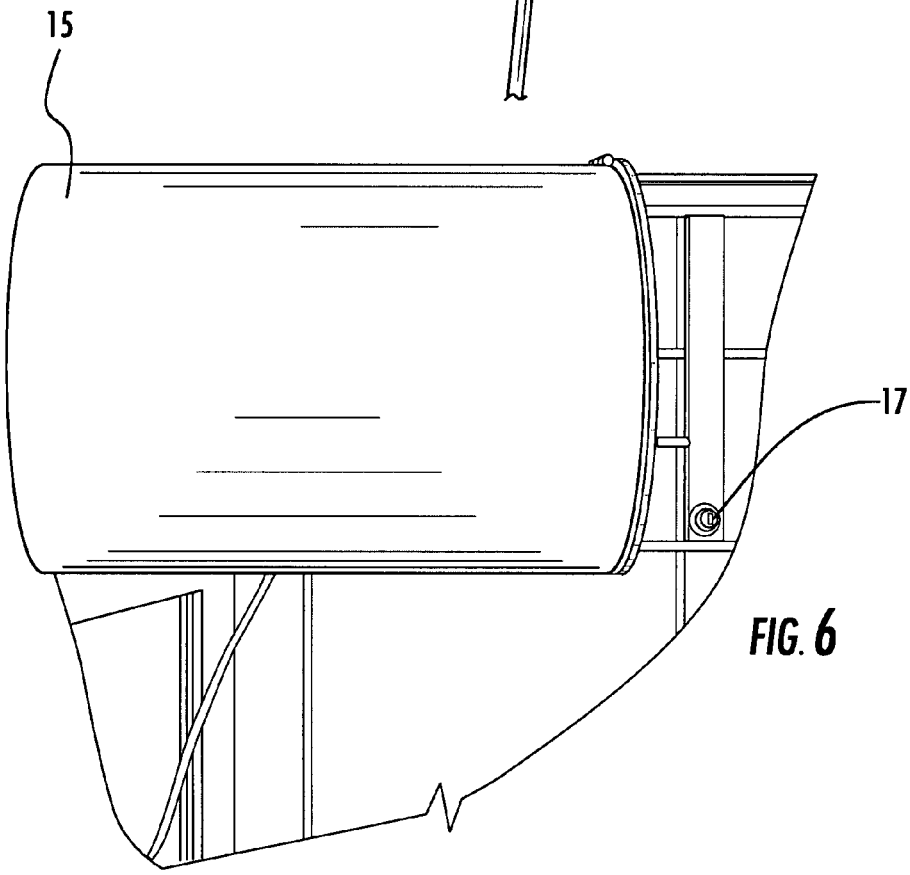
FIG. 6 is a cutaway elevation view of the receiving chute and bottle sensor of the bottle return apparatus of FIG. 1.
Figure 10:
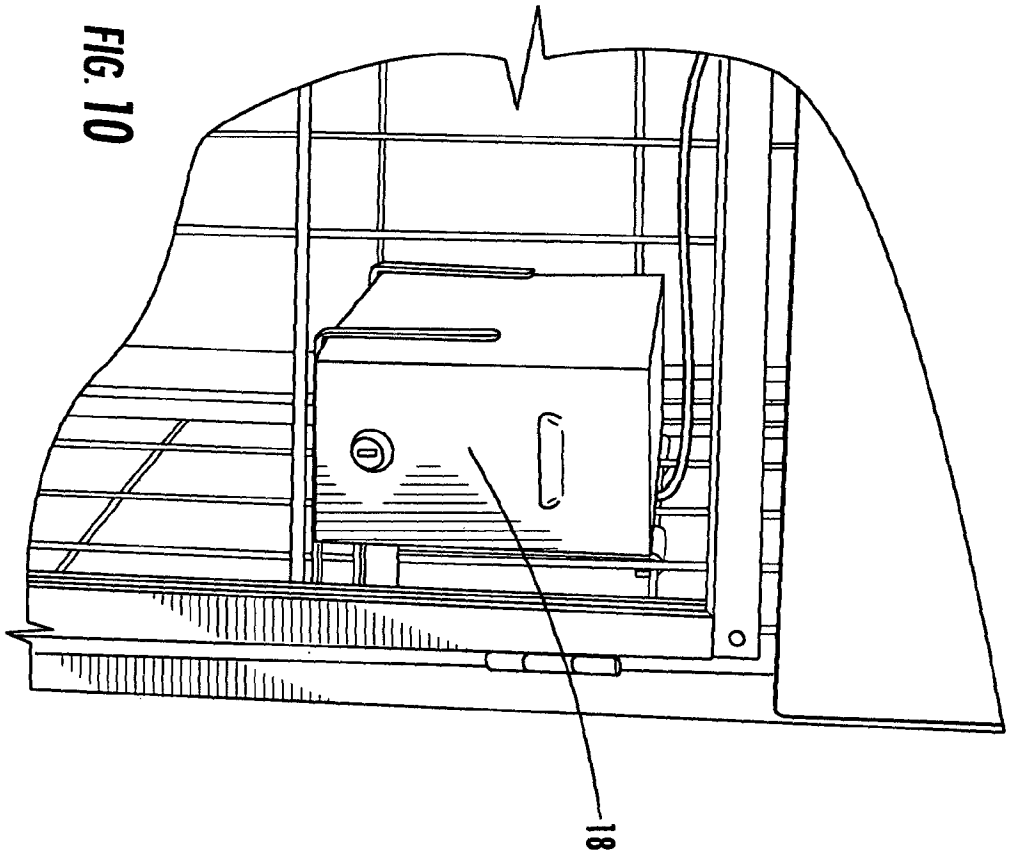
FIG. 10 is a cutaway elevation view of the receipt dispenser of the bottle return apparatus of FIG. 2.

As depicted in FIGS. 1, 5 and 10, the bottle sensor 17 is operatively connected to a receipt dispenser 18, which dispenses a receipt when an empty bottle 16 is deposited in the apparatus 10. As those in the art will appreciate, there are many methods of providing such operative connectivity, including, but not limited to, electrical wiring, mechanical cabling, optical coupling, radio coupling, and the like. When the bottle sensor 17 detects the presence of a bottle entering the bin 11, the bottle sensor 17 activates the receipt dispenser 18, which generates a receipt 19. The receipt dispenser 18 may be a printer that prints a receipt 19 upon being activated by the bottle sensor 17. Alternatively, the receipt dispenser 18 may be a device that dispenses preprinted receipts upon being activated by the bottle sensor 17.

As those in the art will appreciate, there are many receipt dispensers that are suitable for use with the present invention. One such receipt dispenser that may be advantageously used in the present invention is a ticket dispenser, such as the ticket dispenser manufactured by Deltronic Labs, Inc. and designated a model number DL-4-SS.

An RFID printer or other device capable of encoding information onto an RFID tag may also be advantageously used as the receipt dispenser 18.

Figure 9:
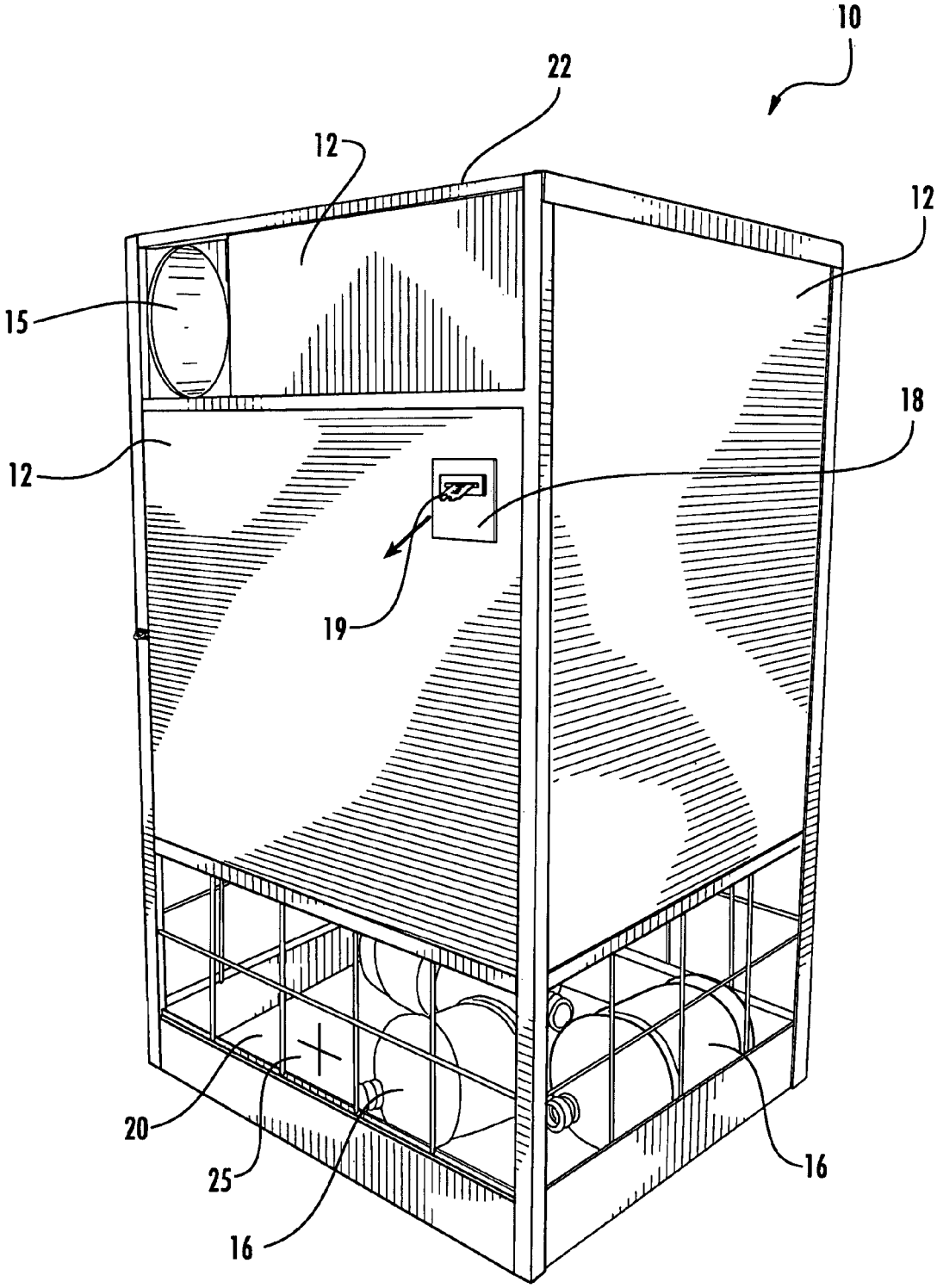
FIG. 9 is a perspective view of the bottle return apparatus of FIG. 2 illustrating a receipt dispenser dispensing a receipt.
Figure 12:
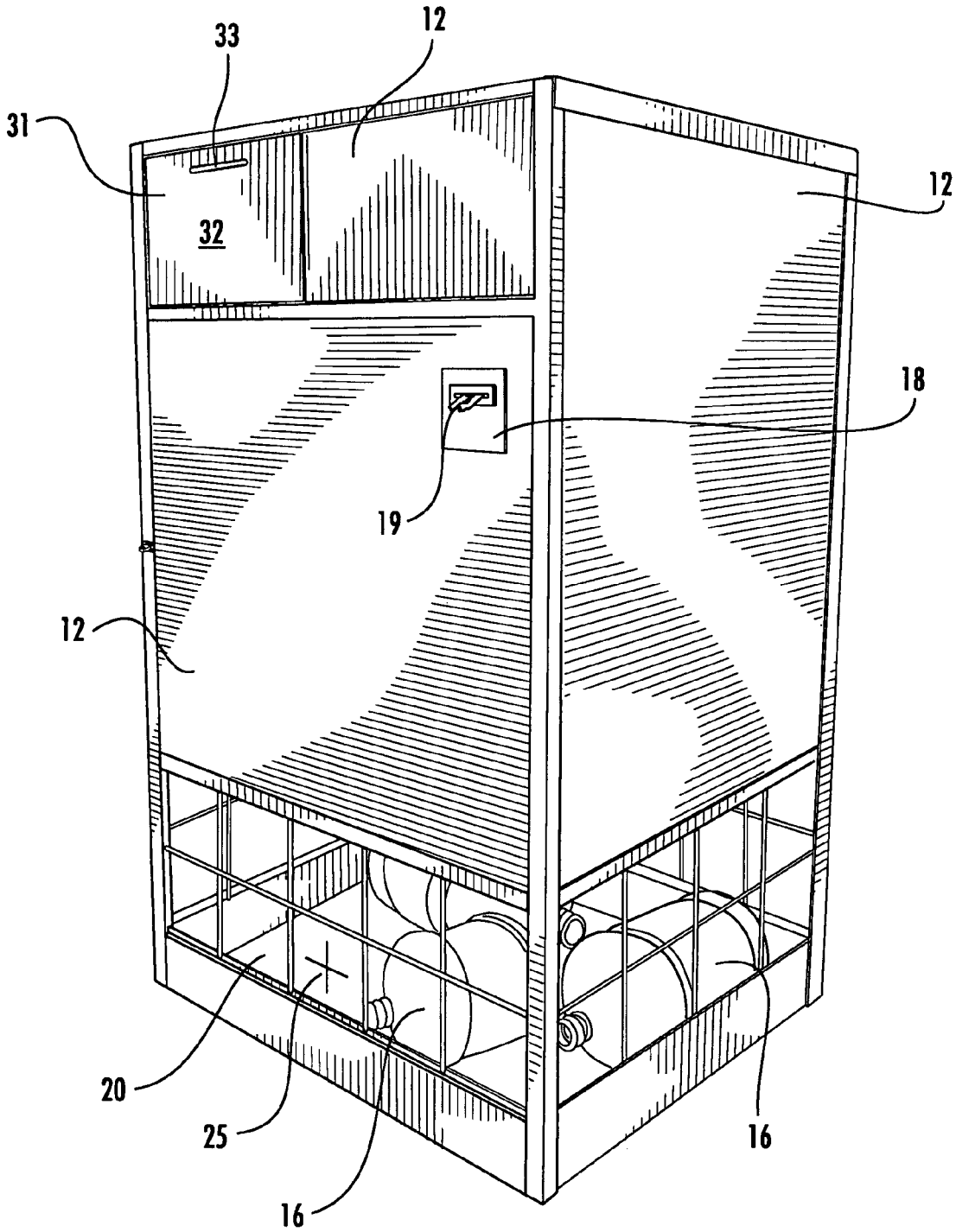
FIG. 12 is a perspective view of a preferred embodiment of a bottle return apparatus in accordance with the present invention.
Figure 16:
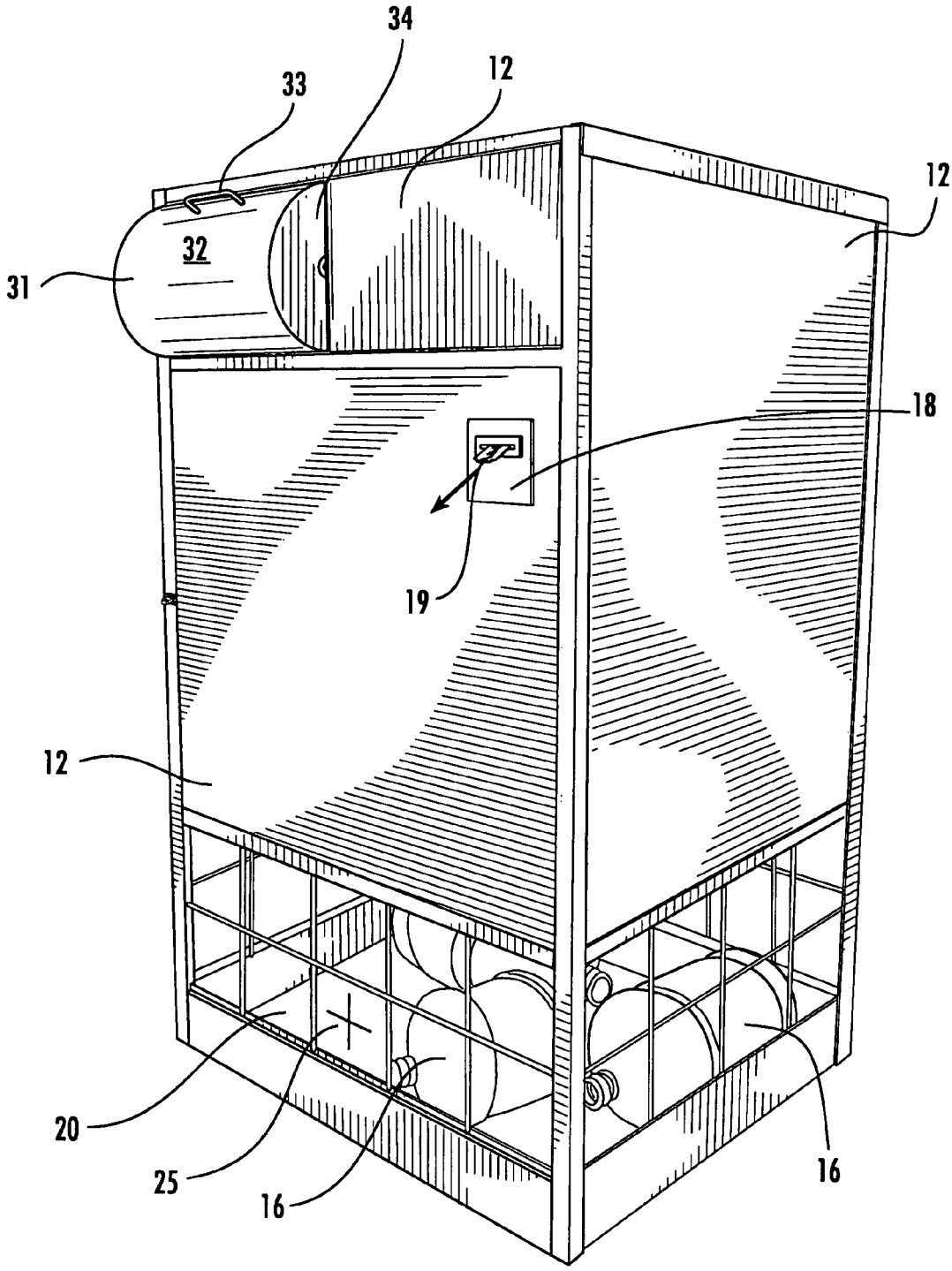
FIG. 16 is a perspective view of a preferred embodiment of a bottle return apparatus in accordance with the present invention.

As illustrated in FIGS. 9, 12 and 16, after a receipt is dispensed by the receipt dispenser 18, a customer having deposited an empty bottle in the apparatus may remove the receipt 19 from the apparatus 10.

Figure 11:
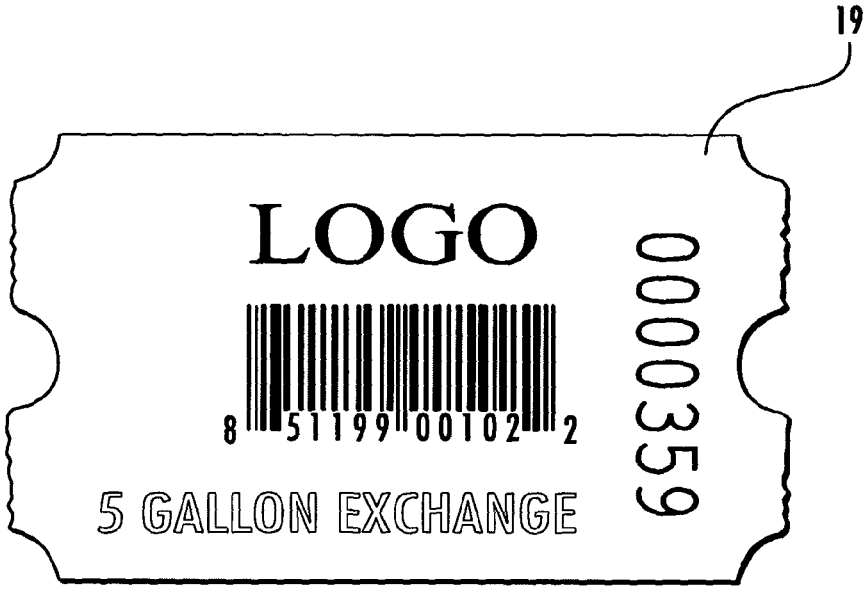
FIG. 11 is a plan view of a receipt having a universal product code disposed thereon.

FIG. 11 illustrates a receipt that may advantageously be used with the present invention. This receipt 19 has product identification indicia that corresponds to the drinking water bottles of the type with which use of the apparatus is intended. The product identification indicia may, for example, include a Universal Product Code ("UPC"), or a Stock Keeping Unit ("SKU") number, or any other indicia used to identify the bottled water product.

The receipt 19 may include an RFID device, such as an RFID tag or so-called "smart label" that contains product identification indicia. RFID-capable receipts may have product identification indicia pre-encoded on RFID tags on the receipts or, if the receipt dispenser is an RFID printer or other device capable of encoding information onto an RFID tag, the receipts may include RFID tags that are encoded with product identification indicia by the receipt dispenser 18.

Product identification indicia may be on one or both sides of the receipt 19. If two sizes of water bottles, 3-gallon and 5-gallon sizes for example, are sold by a particular retailer, the receipt 19 may have product identification indicia corresponding to the 3-gallon size on one side and product identification indicia corresponding to the 5-gallon size on the other side. In this way a customer depositing either the three gallon size or the five gallon size in the apparatus receives a corresponding receipt without the necessity of the apparatus determining which size of bottle has been deposited.

If an RFID reader is used as the bottle sensor 17 and an RFID printer used as the receipt dispenser 18, the receipt 19 may be encoded with RFID product identification indicia corresponding to the size of water bottle associated with the RFID tag that is detected by the bottle sensor when a bottle having an RFID tag enters the apparatus.

Because "empty" beverage bottles often still contain moisture, it is desirable to facilitate air flow around empty water bottles that have been deposited in the bin 11 to help remove moisture from the apparatus 10, dry the empty bottles 16 and provide some deterrence against insect infestation while the bottles 16 are stored in the bin awaiting pick-up and reuse. One or more circulation openings 25 are provided to allow air from the exterior of the bin 11 to pass into the interior of the bin 11 where empty bottles 16 are contained.

Circulation openings 25 may be any desired shape or size. In determining the number, shape and size of circulation openings, consideration should be given to the size of bottles with which the apparatus is intended to be used and the size and number of circulation openings required to facilitate the desire air flow through the apparatus.

In a preferred embodiment, a plurality of circulation openings 25 are provided, each such circulation opening 25 having an area less than the area of the opening of the receiving chute 15. In this way, when the receiving chute 15 is configured to permit only one empty bottle at a time to pass there through, the circulation openings 25 prevent empty bottles 16 from being removed from the bin 11 through the circulation openings 25.

Means for receiving a bottle of predetermined size from outside of the bin 11 into the interior space of the bin other than a receiving chute 15 are also within the scope of the present invention. For example, FIGS. 12-15 and FIGS. 16-18 illustrate preferred embodiments of the present invention in which a receiving tray 31 that rotates around an axis A between an open position and a closed position is used instead of a receiving chute 15.

Figure 13:
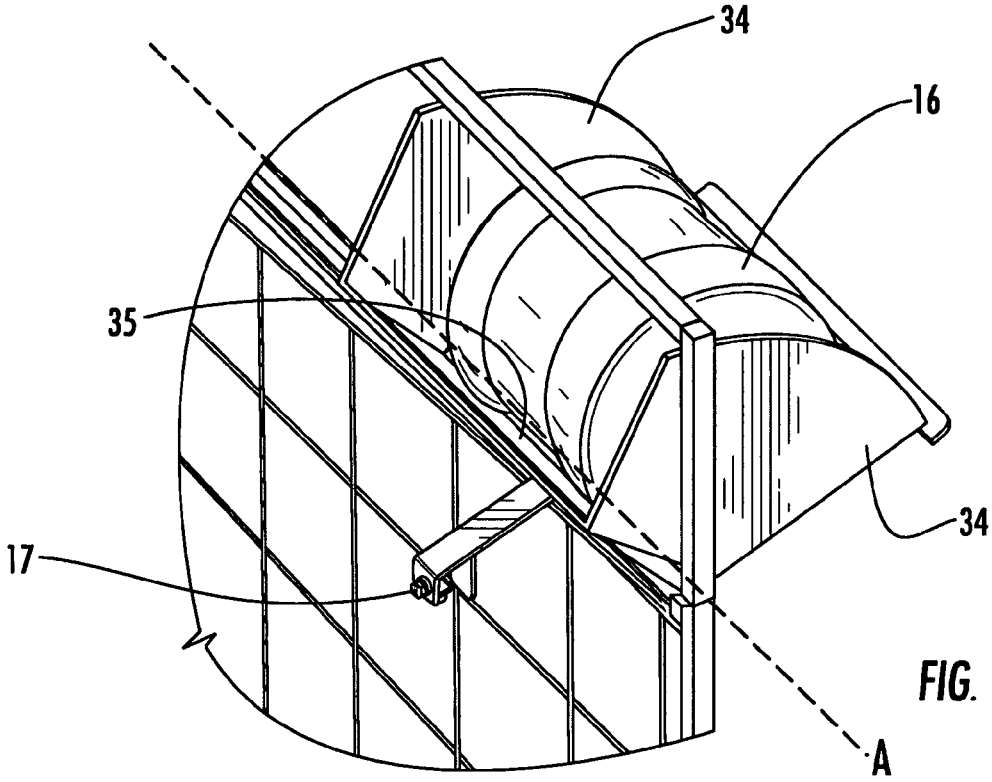
FIGS. 13 and 14 are cutaway perspective views illustrating the receipt of an empty bottle into the apparatus illustrated in FIG. 12 and the detection of the empty bottle by the bottle sensor.
Figure 14:
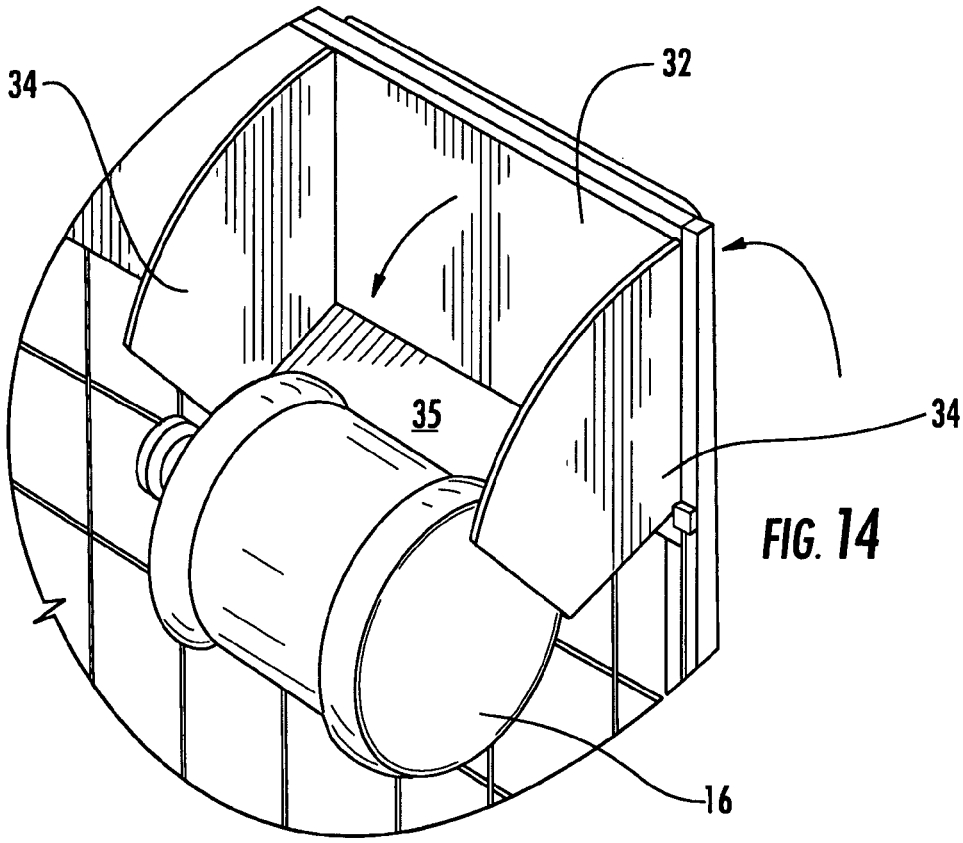
Figure 19:
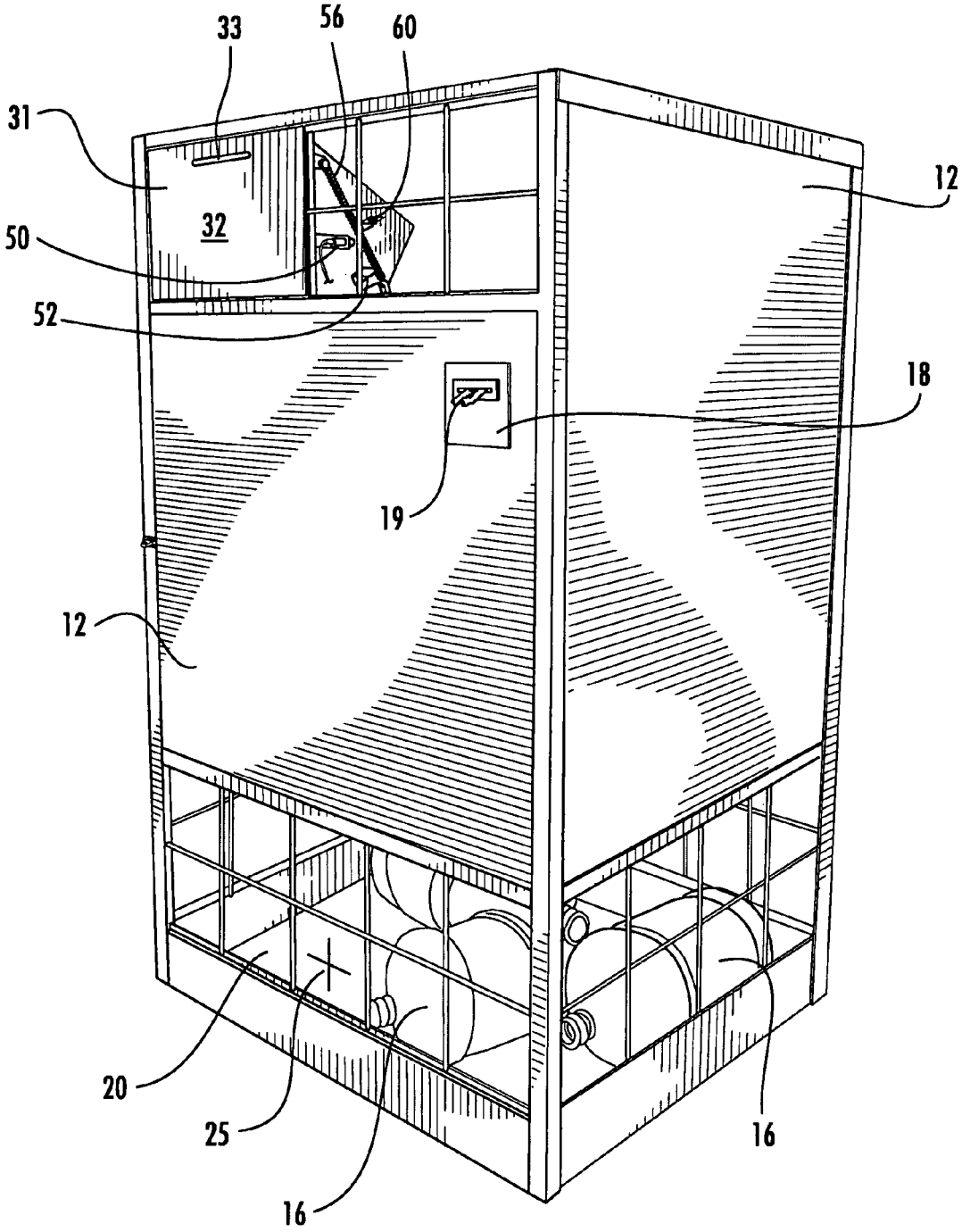
FIG. 19 is a perspective view of a preferred embodiment of a bottle return apparatus in accordance with the present invention having an activation sensor and a bottle sensor.

In a preferred embodiment illustrated in FIGS. 12-15, the exterior tray wall 32 of the receiving tray 31 when in the closed position is generally flat and may be flush with an exterior surface of a wall 21 of the apparatus 10. A handle 33 extends outwardly from the exterior tray wall 32. As illustrated in FIGS. 13 and 14, the receiving tray 31 in this preferred embodiment has two tray side walls 34 and an interior tray wall 35. The receiving tray 31 of this preferred embodiment is attached to the bin 11 in such a way that the receiving tray 31 rotates about an axis A that runs generally along the line formed by the joint between the exterior tray wall 32 and the interior tray wall 35. A hinge may be used to attach the receiving tray 31 to the bin 11 and thereby create this rotating motion. A spring similar to that shown in FIG. 19 or other biasing mechanism may be used to bias the receiving tray in a normally shut position.

To deposit an empty bottle 16 into the bin 11 in this preferred embodiment, the receiving tray 31 is pulled using the handle 33 to the open position (illustrated in FIG. 13), a bottle is placed in the receiving tray 31, and the receiving tray 31 is returned to the closed position (illustrated in FIGS. 12 and 14), whereupon the bottle 16 falls into the bin 11 by gravity (illustrated in FIG. 14). A spring mechanism or other known device may be used to bias the receiving tray 31 in the closed position.

Figure 15:
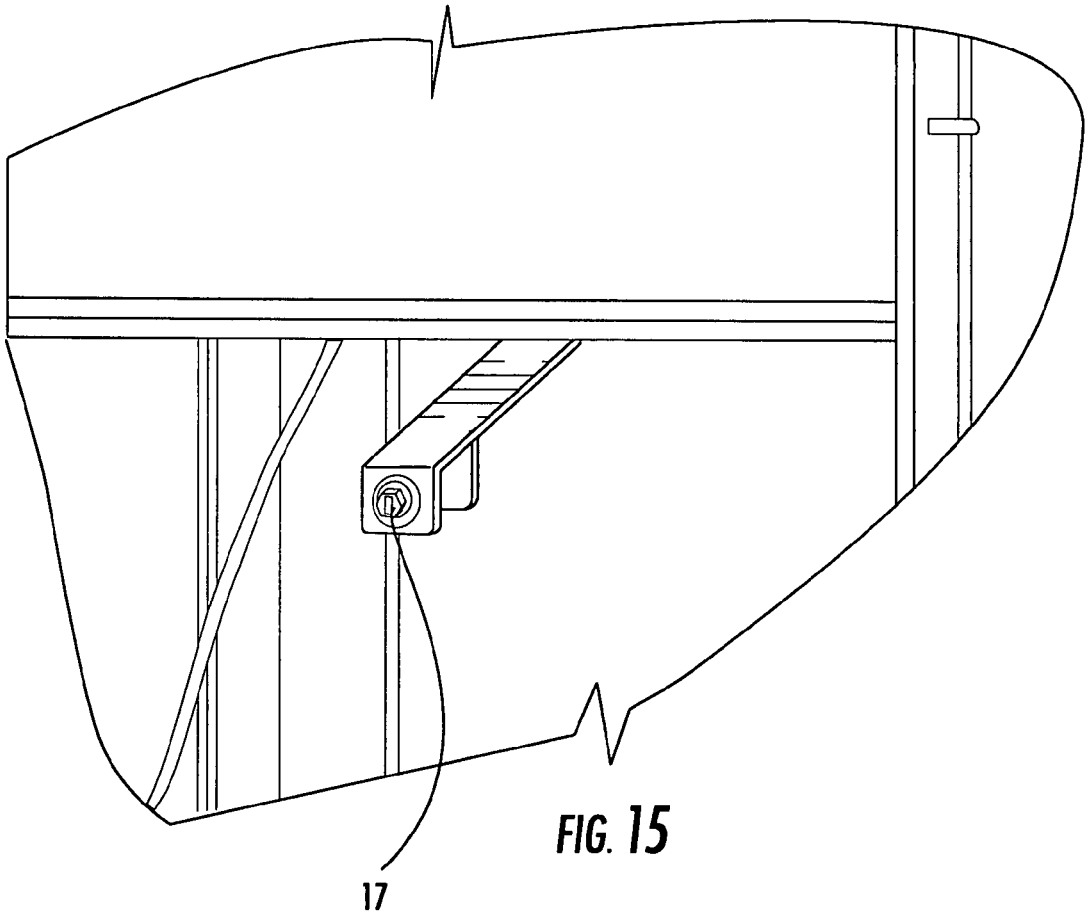
FIG. 15 is a cutaway perspective view of a bottle sensor of the bottle return apparatus illustrated in FIG. 12.

As illustrated in FIGS. 13 and 15, the bottle sensor 17 in this preferred embodiment may advantageously be positioned in the bin 11 under the receiving tray 31 so as to detect a bottle 16 falling from the receiving tray 31 into the bin 11.

Figure 17:
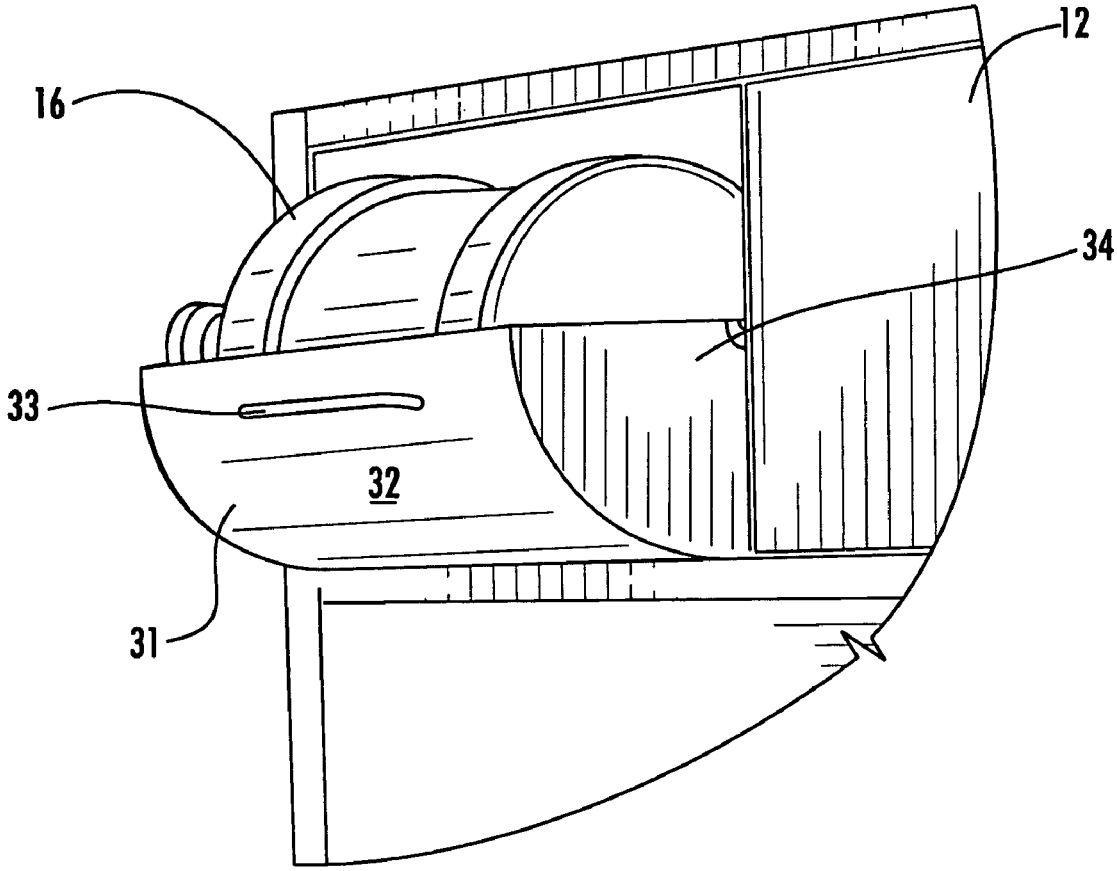
FIGS. 17 and 18 are perspective views illustrating the receipt of an empty bottle into the apparatus illustrated in FIG. 16 and the detection of the empty bottle by the bottle sensor.
Figure 18:
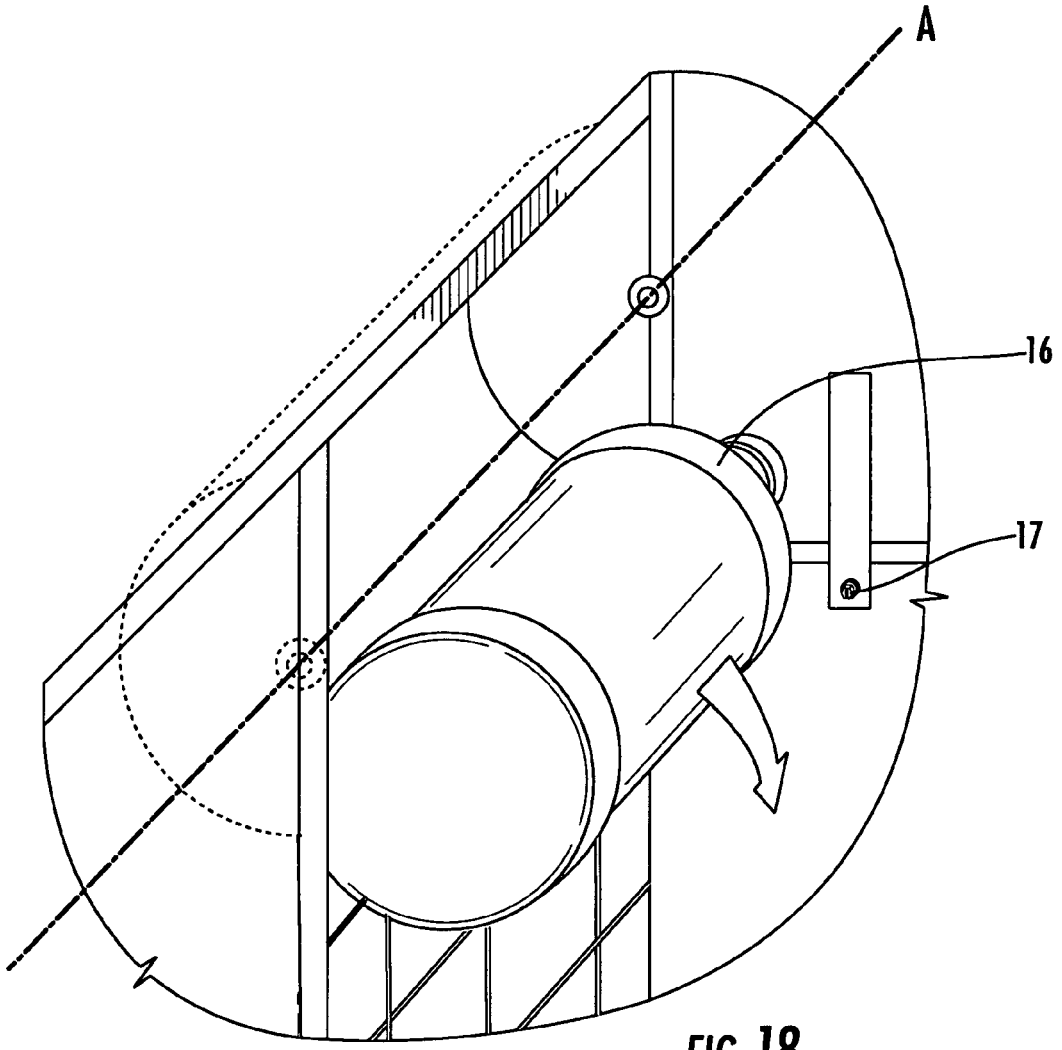

In a preferred embodiment illustrated in FIGS. 16-18, the exterior tray wall 32 of the receiving tray 31 is arcuate and each tray side wall 34 is semicircular. As illustrated in FIG. 16, in the closed position the arcuate exterior tray wall 32 in this preferred embodiment extends outwardly from the wall 21 of the apparatus. A handle 33 extends outwardly from the exterior tray wall 32.

As illustrated in FIGS. 17 and 18, the receiving tray 31 in this preferred embodiment is attached to the bin 11 in such a way that the receiving tray 31 rotates about an axis A generally located along a line connecting the mid point of the straight edge of each semicircular tray side wall 34.

To deposit a bottle into the bin in this preferred embodiment, the receiving tray 31 is pulled using the handle 33 to the open position (illustrated in FIG. 17), a bottle is placed in the receiving tray 31, and the receiving tray 31 is returned to the closed position whereupon the bottle 16 falls into the bin 11 by gravity (illustrated in FIG. 18). When the receiving tray 31 is in the open position, a portion of the arcuate exterior tray wall 32 extends into the interior of the bin 11. A spring mechanism or other known device may be used to bias the receiving tray 31 in the closed position.

The bottle sensor 17 in this preferred embodiment may be positioned in the bin 11 under the receiving tray 31 so as to detect a bottle falling from the receiving tray 31 into the bin 11, as previously described. Alternatively, and as illustrated in FIG. 18, the bottle sensor 17 in this preferred embodiment may be positioned on the interior side of a wall 21 of the bin 11 so as to detect a bottle falling from the receiving tray 31 into the bin 11.

In a preferred embodiment illustrated in FIGS. 19-23, in addition to a bottle sensor 17 as described above, an activation sensor 50 is used in association with a receiving tray 31 having an activation tab 52, weight 54 and a stop member 60 affixed or mounted to one or both of the tray side walls 34. One or more spring mechanisms 56 connect the receiving tray 31 and the bin 11.

The receiving tray 31 in this preferred embodiment is attached to the bin 11 in such a way that the receiving tray 31 rotates about an axis A that runs generally along the line formed by the joint between the exterior tray wall 32 and the interior tray wall 35. To deposit an empty bottle 16 into the bin 11, the receiving tray 31 is pulled using the handle 33 to the open position (illustrated in FIG. 21), a bottle is placed in the receiving-tray 31, and the receiving tray 31 is returned to the closed position (illustrated in FIG. 22), whereupon the bottle 16 falls into the bin 11 by gravity.

The receiving tray may include a weight 54 at the base of an interior portion of the receiving tray 31. The weight 54 may be composed of any desired material having sufficient mass to support retention of the receiving tray 31 in the closed position. Advantageously, the weight 54 helps prevent the receiving tray 31 from moving from the closed position to the open position without a user pulling the handle 33 to overcome the force exerted by the weight 54. The weight 54 may, for example, be a solid metal bar attached at the base of an interior portion of the receiving tray 31.

Figure 20:
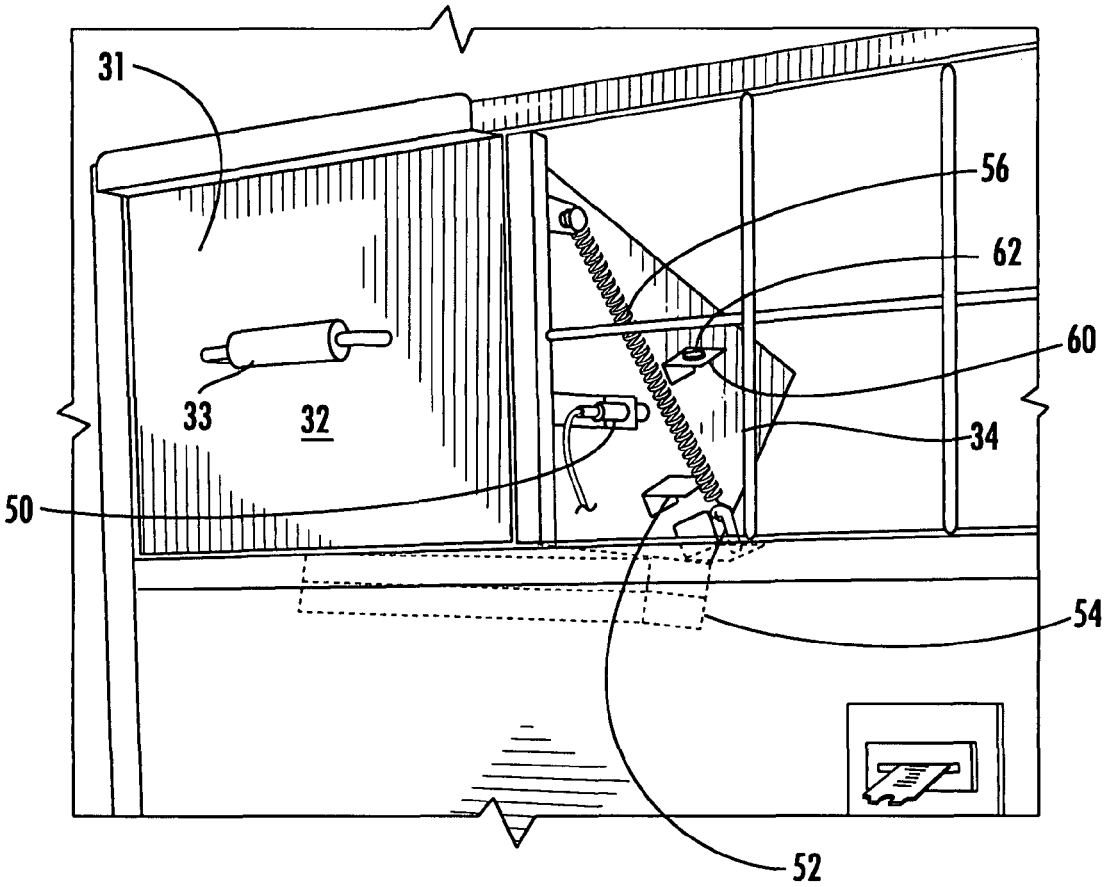
FIG. 20 is a cutaway perspective view of the apparatus of FIG. 19.
Figure 21:
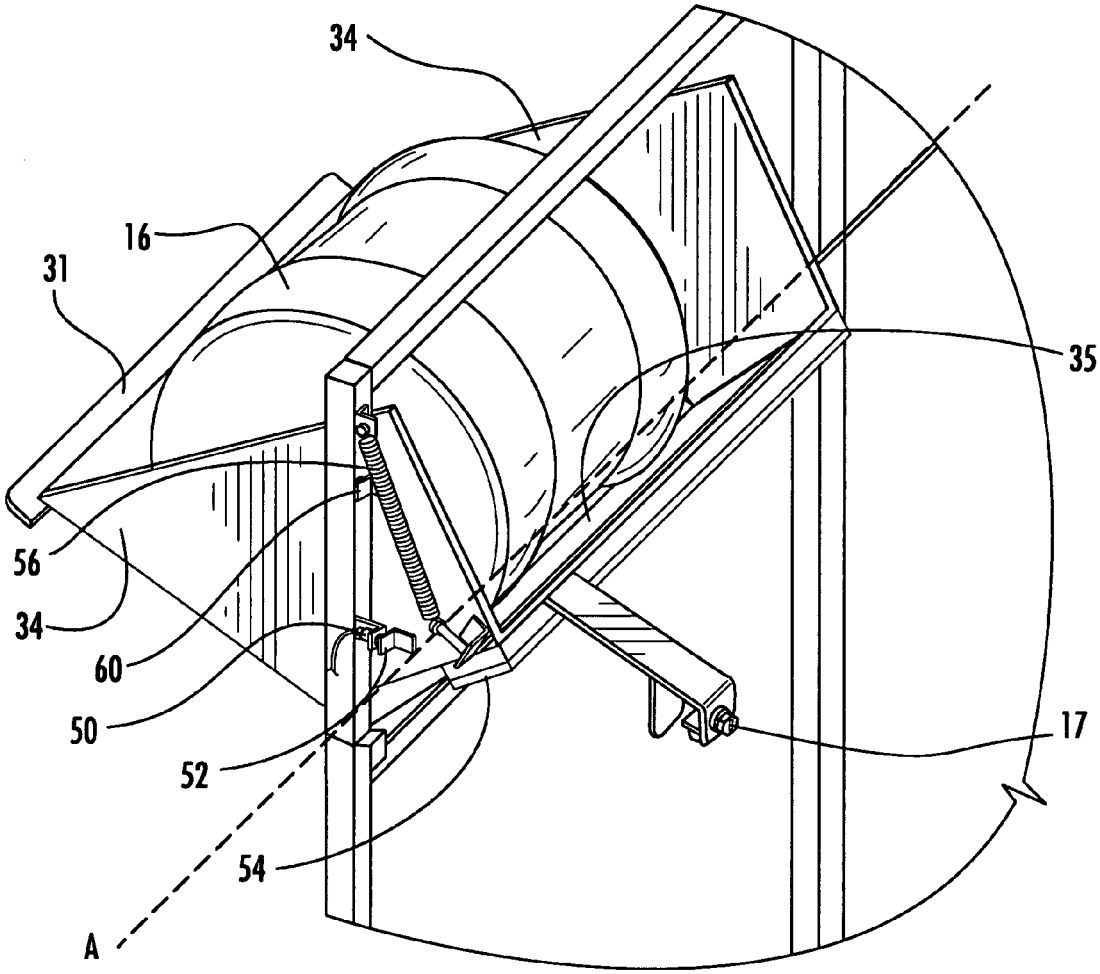
FIGS. 21 and 22 are cutaway perspective views illustrating the receipt of an empty bottle into the apparatus illustrated in FIG. 19.
Figure 22:
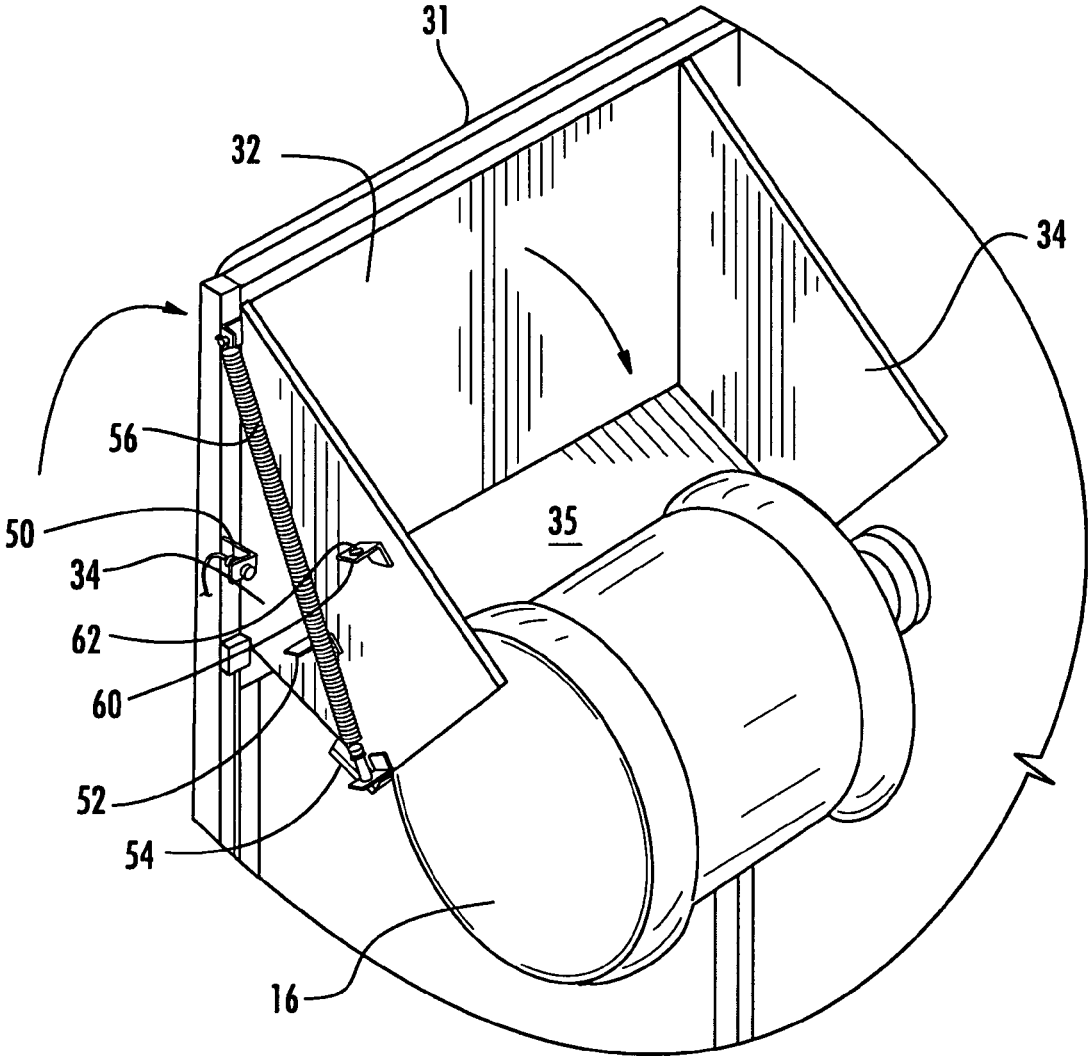

As illustrated in FIGS. 20-22, a spring mechanism 56 connects the receiving tray 31 and the bin 11 to bias the receiving tray 31 in the closed position. Along with the weight 54 at the base of an interior portion of the receiving tray 31, the spring mechanism 56 also helps promote a smooth rotation of the receiving tray 31 between the closed position and the open position.

As illustrated in FIGS. 20-21, a stop member 60 positioned on the receiving tray 31 may be used to stop rotational movement of the receiving tray 31 once the receiving tray 31 has moved from the closed position to the fully open position. The stop member 60 may be arranged so as to engage a portion of the bin 11 when the receiving tray 31 has moved from the closed position to the open position. Advantageously, the stop member 60 may be a metal tab positioned on one or both of the tray side walls 34 of the receiving tray 31. The stop member 60 may also include a rubber foot 62 positioned on the stop 60 so as to abut the bin 11 when the receiving tray 31 is in the open position.

An activation sensor 50 is positioned on the bin 11 pointing toward the interior of the bin 11 and a corresponding activation tab 52 is affixed or mounted to one of the tray side walls 34 of the receiving tray 31 such that the activation sensor 50 senses the presence of the activation tab 52 when the receiving tray 31 is fully open.

The activation sensor 50 may be of any particular type and may, for example, be a mechanical, electrical, magnetic, inductive proximity, or optical sensor, all of which are known to those in the art. One such sensor suitable for use in the present invention is a 4 mm shielded inductive proximity sensor manufactured by SICK, Inc.

The activation tab 52 may be of any suitable type. In a preferred embodiment in which an inductive proximity sensor is used as the activation sensor 50, the activation tab 52 is an "L-shape" metal piece having one portion of the "L" mounted flush to the tray side wall 34 and the other portion of the "L" extending in a generally perpendicular direction away from the tray side wall 34.

Figure 23:
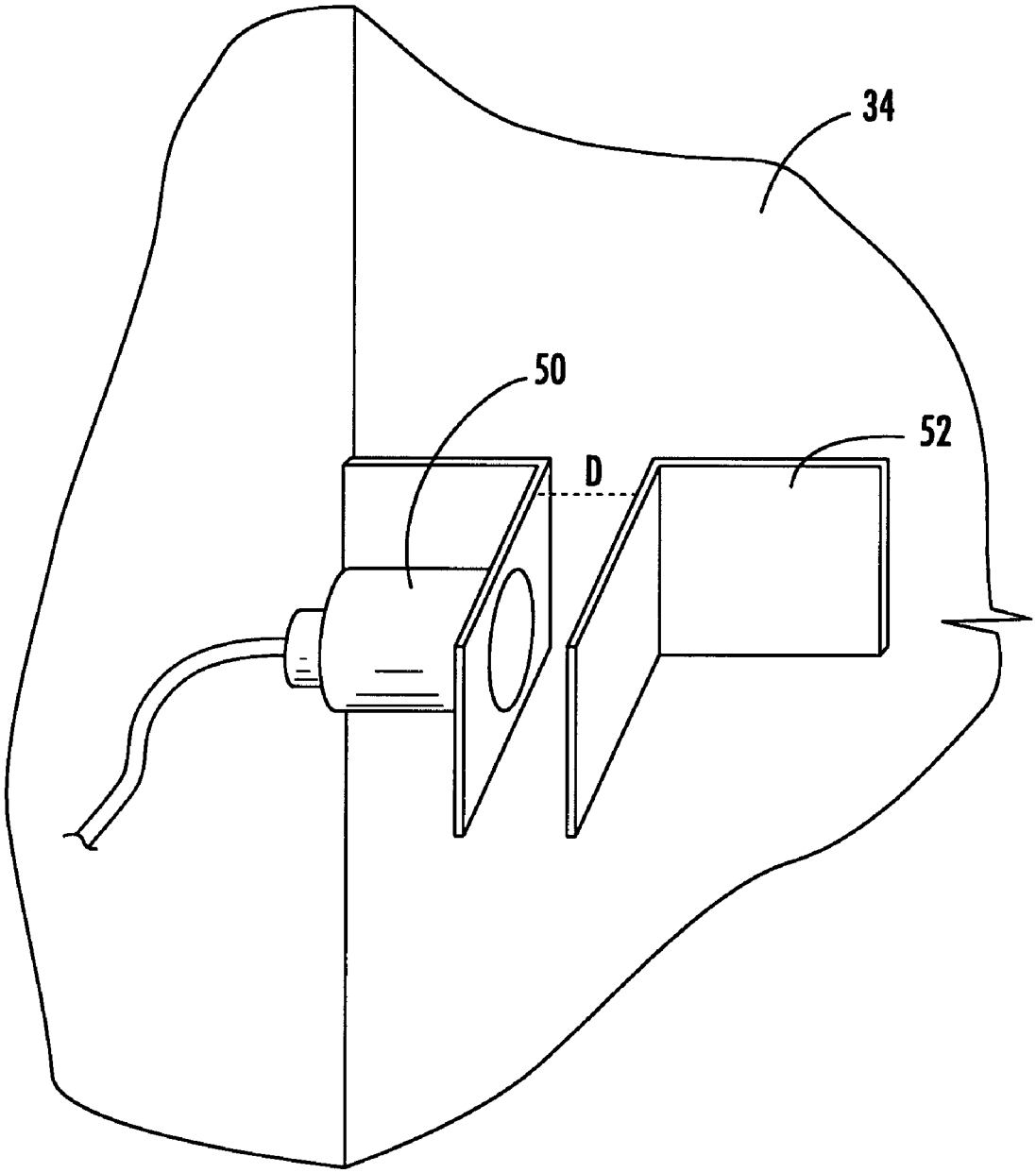
FIG. 23 is a close-up cutaway perspective view of the activation sensor.

When the receiving tray is in the open position, as illustrated in FIGS. 21 and 23, the activation tab 52 is located a predetermined distance D from the activation sensor 50, which predetermined distance D is within the operational detection range of the activation sensor 50. For example, a predetermined distance D of around 4 mm has been found suitable for use in the present invention in conjunction with an activation sensor having an operable detection range of between 1 mm and 100 mm. When the receiving tray 31 is in the closed position, as illustrated in FIGS. 20 and 22, the activation tab 52 is spaced from the activation sensor 50 by a sufficient distance such that the activation sensor 50 is unable to detect the presence of the activation tab 52.

In the embodiment of the present invention illustrated in FIGS. 19-23, the activation sensor 50 and the bottle sensor 17 are each electrically connected to the ticket dispenser 18 and the control board of the ticket dispenser 18 is programmed such that the ticket dispenser 18 will only dispense a receipt 19 if the bottle sensor 17 detects the presence of a bottle received into the interior of the bin 11 within a predetermined time period after the activation sensor 50 senses the presence of the activation tab 52, thereby indicating that the receiving tray 31 is fully open. Such predetermined time period should be selected in consideration of how much time is normally required for a person to open the receiving tray, deposit a bottle therein, and then shut the receiving tray. A period of around 5 seconds has been found to be suitable for use as such predetermined time period.

As those in the art will appreciate, such predetermined period of time may be made to commence when the activation sensor first detects the presence of the activation tab as the receiving tray is moving toward the fully open position, or the predetermined period of time may be made to commence when the activation sensor no longer detects the presence of the activation tab as the receiving tray is moving toward the fully closed position.

Use of a bottle sensor in combination with an activation sensor as described above increases the likelihood that a person receiving a receipt from the apparatus will have actually deposited an empty bottle into the apparatus because a receipt will not be dispensed unless the receiving tray has previously been opened. A person depositing an empty bottle into the apparatus of this preferred embodiment must open the receiving tray 31, thereby bringing the activation tab 52 that is affixed on the receiving tray 31 to a position within the operational detection range of the activation sensor 50. In order to receive a receipt, the person must then deposit the empty bottle into the receiving tray and close the tray, thereby causing the empty bottle to fall into the bin and be detected by the bottle sensor within the predetermined period of time.

As illustrated in FIG. 20, the handle 33 extending outwardly from the exterior tray wall 32 may have a cylindrical shape, as may be found in connection with the handles of water bottles that may be deposited in the bin. Such cylindrical shape of the handle 33 may suggest to users the proper orientation of water bottles to be deposited in the receiving bin 11.

The apparatus of the present invention thus eliminates the problematic need for a store employee to be present when a customer returns an empty bottle in order to verify the return, receive the empty bottle and store it. Using the apparatus of the present invention, a customer simply deposits an empty water bottle 16 into the bin 11 and receives a receipt 19 for the deposited bottle. The receipt 19 has product identification indicia thereon that corresponds to a full drinking water bottle. The customer may then take the receipt 19 from the apparatus and present the receipt to the store cashier when purchasing a full bottle of drinking water. In this way, the receipt 19 can serve both as evidence of bottle return and as a "price tag" that can be entered, scanned or read if a purchaser who returns an empty bottle desires to buy a new full water bottle.

It will be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A drinking water bottle return apparatus comprising:

a bin having an interior space capable of holding a plurality of drinking water bottles of predetermined size;

a receiving tray movable between an open position and a closed position and being adapted and positioned such that when said receiving tray is in the open position a drinking water bottle of predetermined size can be placed in said receiving tray from outside of the apparatus, when said receiving tray is in the closed position said receiving tray prevents passage of a drinking water bottle of predetermined size into said receiving tray from outside of the apparatus and when said receiving tray is moved from the open position to the closed position a drinking water bottle of predetermined size placed in said receiving tray while in the open position enters into said bin;

a first sensor adapted and positioned to detect said receiving tray in the open position, a second sensor adapted and positioned to detect a drinking water bottle of predetermined size entering said bin; and a receipt dispenser operatively connected to said first sensor and to said second sensor such that said receipt dispenser dispenses a receipt therefrom in response to detection by said second sensor of a drinking water bottle of predetermined size entering said bin within a predetermined time period after detection by said first sensor of said receiving tray in the open position.

2. A drinking water bottle return apparatus as defined in claim 1 wherein said receiving tray is adapted and positioned such that a drinking water bottle of predetermined size cannot pass through said receiving tray into said bin when said receiving tray is in the open position.

3. A drinking water bottle return apparatus as defined in claim 1 wherein said first sensor is adapted and positioned such that said first sensor does not detect said receiving tray in the closed position.

4. A drinking water bottle return apparatus as defined in claim 1 wherein the predetermined time period commences when said first sensor initially detects said receiving tray as said receiving tray moves from the closed position toward the open position.

5. A drinking water bottle return apparatus as defined in claim 1 wherein the predetermined time period commences when said first sensor no longer detects said receiving tray as said receiving tray moves from the open position toward the closed position.

6. A drinking water bottle return apparatus as defined in claim 1 wherein said receiving tray rotates at least partially about a generally horizontal axis as said receiving tray moves between the closed position and the open position.

7. A drinking water bottle return apparatus as defined in claim 1 wherein said receiving tray rotates at least partially about a generally vertical axis as said receiving tray moves between the closed position and the open position.

8. A drinking water bottle return apparatus as defined in claim 1 further comprising an activation tab affixed to said receiving tray such that said activation tab is a predetermined distance from said first sensor when said receiving tray is in the open position and such predetermined distance is within the detection range of said first sensor.

9. A drinking water bottle return apparatus as defined in claim 8 wherein the predetermined distance is within the range of about one millimeter and about one hundred millimeters.

10. A drinking water bottle return apparatus as defined in claim 1 further comprising a weight affixed to said receiving tray.

11. A drinking water bottle return apparatus as defined in claim 1 further comprising a biasing mechanism maintaining said receiving tray in the closed positioned until said receiving tray is opened by a person depositing a drinking water bottle into said bin.

12. A drinking water bottle return apparatus as defined in claim 11 wherein said biasing mechanism comprises a spring connecting said receiving tray and said bin.

13. A drinking water bottle return apparatus as defined in claim 1 wherein the predetermined period of time is within the range of about two seconds to about six seconds.

14. A drinking water bottle return apparatus as defined in claim 1 wherein said first sensor is an inductive proximity sensor.

15. A drinking water bottle return apparatus as defined in claim 1 wherein said second sensor is a mechanical sensor.

16. A drinking water bottle return apparatus as defined in claim 1 wherein said second sensor is an electro-optical sensor.

17. A drinking water bottle return apparatus as defined in claim 14 wherein said second sensor is an electro-optical sensor.

18. A drinking water bottle return apparatus as defined in claim 1 wherein said second sensor is a device capable of detecting the presence of an RFID tag.

19. A drinking water bottle return apparatus as defined in claim 1 wherein said receipt dispenser dispenses receipts having product identification indicia thereon corresponding to drinking water bottles deposited in the apparatus.

20. A drinking water bottle return apparatus as defined in claim 1 wherein said receipt dispenser is a device capable of encoding information onto an RFID tag.

21. A drinking water bottle return apparatus as defined in claim 20 wherein said receipt dispenser dispenses receipts having an RFID tag.

22. A drinking water bottle return apparatus comprising:

a bin having an interior space capable of holding a plurality of drinking water bottles of predetermined size and an opening through which bottles of a predetermined size may be deposited into said bin from outside of the apparatus;

a door movable between a closed position in which said door prevents passage of a bottle of predetermined size through the opening and an open position in which a drinking water bottle of predetermined size can travel through the opening unobstructed by said door;

a first sensor adapted and positioned to detect said door in the open position, a second sensor adapted and positioned to detect a drinking water bottle of predetermined size entering said bin; and a receipt dispenser operatively connected to said first sensor and to said second sensor such that said receipt dispenser dispenses a receipt therefrom in response to detection by said second sensor of a drinking water bottle of predetermined size entering said bin within a predetermined time period after detection by said first sensor of said door in the open position.

23. A drinking water bottle return apparatus as defined in claim 22 wherein said door rotates at least partially about a generally horizontal axis as said door moves between the closed position and the open position.

24. A drinking water bottle return apparatus as defined in claim 22 wherein said door rotates at least partially about a generally vertical axis as said door moves between the closed position and the open position.

25. A drinking water bottle return apparatus as defined in claim 22 wherein said first sensor is adapted and positioned such that said first sensor does not detect said door in the closed position.

26. A drinking water bottle return apparatus as defined in claim 22 wherein the predetermined time period is less than ten seconds.

27. A drinking water bottle return apparatus as defined in claim 22 wherein said first sensor is an inductive proximity sensor.

28. A drinking water bottle return apparatus as defined in claim 22 wherein said second sensor is a mechanical sensor.

29. A drinking water bottle return apparatus as defined in claim 22 wherein said second sensor is an electro-optical sensor.

30. A drinking water bottle return apparatus as defined in claim 27 wherein said second sensor is an electro-optical sensor.

* * * * *